US006278228B1

(12) United States Patent
Iwase et al.

(10) Patent No.: US 6,278,228 B1
(45) Date of Patent: Aug. 21, 2001

(54) COLD CATHODE FIELD EMISSION DEVICE AND COLD CATHODE FIELD EMISSION DISPLAY

(75) Inventors: Yuichi Iwase, Kanagawa; Masami Okita, Tokyo, both of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/357,851

(22) Filed: Jul. 21, 1999

(30) Foreign Application Priority Data

Jul. 23, 1998 (JP) ..... 10-208391
May 10, 1999 (JP) ..... 11-128634

(51) Int. Cl.[7] ..... H01J 1/304; H01J 19/22
(52) U.S. Cl. ..... 313/306; 313/309
(58) Field of Search ..... 313/309, 336, 313/351, 495, 496, 497, 306

(56) References Cited

U.S. PATENT DOCUMENTS 5,214,347 5/1993 Gray ..... 313/309
5,466,982 * 11/1995 Akinwande ..... 313/309
5,691,600 * 11/1997 Moyer et al. ..... 313/309
5,804,909 * 9/1998 Nilsson et al. ..... 313/309
5,848,925 * 12/1998 Howard et al. ..... 313/306
6,114,802 * 9/2000 Amrine et al. ..... 313/309

* cited by examiner

*Primary Examiner*—Michael H. Day
(74) *Attorney, Agent, or Firm*—Ronald P. Kananen; Rader, Fishman & Grauer

(57) ABSTRACT

A cold cathode field emission device having an electron emission layer (14), an insulating layer and a gate electrode (12) which are laminated one on another with the insulating layer positioned between the gate electrode, and the electron emission layer (14), and further having an opening portion which penetrates through at least the insulating layer and the electron emission layer, the electron emission layer having an edge portion for emitting electrons, the edge portion being projected on a wall surface of the opening portion, and the electron emission layer being connected to a power source through a resistance layer (23).

13 Claims, 19 Drawing Sheets

[STEP-100]

[STEP-110]

[STEP-120]

[STEP-130]

[STEP-140]

[STEP-150]

[STEP-160]

[STEP-170]

COLD CATHODE FIELD EMISSION DEVICE AND COLD CATHODE FIELD EMISSION DISPLAY

BACKGROUND OF THE INVENTION AND RELATED ART STATEMENT

The present invention relates to a cold cathode field emission device and a cold cathode field emission display into which the cold cathode field emission device is incorporated.

Various flat type, or flat panel type displays are being studied as an image display which is to replace currently main-stream cathode ray tubes (CRT). The flat type displays include a liquid crystal display (LCD), an electroluminescence display (ELD) and a plasma display panel (PDP). Further, there is also proposed a cold cathode field emission display capable of emitting electrons into a vacuum from a solid without relying on thermal excitation, and it attracts attention from the viewpoint of a brightness on a screen and a low power consumption.

The cold cathode field emission display (to be sometimes simply referred to as "display" hereinafter) generally has a configuration in which a cathode panel and an anode panel are arranged so as to face each other through a vacuum layer. The cathode panel has electron emission portions corresponding to two-dimensionally arranged pixels having a gridiron pattern. The anode panel has a fluorescence layer which emits light by its excitation due to a collision with electrons emitted from the electron emission portions. On individual pixels on the cathode panel, generally, a plurality of electron emission portions are formed, and gate electrodes are also formed for emitting electrons from the electron emission portions. An element constituted of the above electron emission portion and the above gate electrode will be referred to as a cold cathode field emission device or a field emission device hereinafter.

In the above display, for attaining a large emission electron current with a low driving voltage, each electron emission portion is required to have a sharply pointed form, it is required to scale down electron emission portions in a block corresponding to one pixel for increasing the density of the electron emission portions, and it is required to decrease a distance between the top end portion of each electron emission portion and each gate electrode. Cold cathode field emission devices having various configurations have been so far proposed for complying with the above requirements.

As a typical example of conventional field emission devices, there is known a so-called Spindt-type field emission device having electron emission portions composed of an electrically conductive material having a conical form. On the cathode panel side of a display into which the Spindt-type field emission devices are incorporated, a cathode electrode, an insulating layer and a gate electrode are consecutively formed on a supporting substrate. Many fine opening portions having a diameter of approximately 1 $\mu$m are formed in a two-dimensional matrix form so as to penetrate through the gate electrode and the insulating layer, and the electron emission portions are formed on the cathode electrode exposed in bottoms of the opening portions. When a voltage is applied to the gate electrode constituting an edge of the opening portion, electrons are emitted from the top end portion of the electron emission portion depending upon the intensity of an electric field generated by the voltage application. Emitted electrons are drawn out of the opening portion and collide with the fluorescence layer on the anode panel side to excite the fluorescence layer and to allow the fluorescence layer to emit light, so that the electrons serve to form an intended image. The conical electron emission portion composed of an electrically conductive material is formed, in a self-aligning manner, by decreasing the amount of depositing particles of the electrically conductive material which can strike into the opening portion, with the passage of time by utilizing the shielding effect of an overhung deposit of the electrically conductive material deposited around the edge of the opening portion during the vertical deposition of the electrically conductive material.

The electron emission characteristic of the Spindt-type field emission device is largely dependent upon the distance from the edge of the gate electrode constituting the edge of the opening portion to the top end portion of the electron emission portion. Actually, however, it is difficult to form the electron emission portions having a uniform form and uniform dimensions in the entirety of the supporting substrate having a large area, and some in-plane deviation and a deviation among lots are inevitable. The deviations cause image displaying characteristics of a display, for example, a brightness of images to vary.

For overcoming the above defects of the Spindt-type field emission device, a so-called edge-type field emission device has been proposed. In one example of the edge-type field emission device, the conical electron emission portions in the Spindt-type field emission device are replaced with projections formed by consecutively forming, on an insulating substrate as a supporting substrate, a first insulating layer, an electron emission layer, a second insulating layer and a gate electrode to form a laminate, forming an opening portion in the laminate, and projecting an edge (end portion or the projection) of the electron emission layer by some method, which edge is exposed on a wall surface of the opening portion.

As a method of projecting the edges of the electron emission layer from the wall surfaces of the opening portions, generally, there is employed a method in which the above laminate is processed by combining anisotropic etching and isotropic etching. That is, the gate electrode is etched under an anisotropic condition, the second insulating layer immediately below the gate electrode is etched under an isotropic condition, the electron emission layer immediately below the second insulating layer is etched under an anisotropic condition, and the first insulating layer immediately below the electron emission layer is etched under an isotropic condition, whereby the wall surfaces of the first insulating layer and the second insulating layer are "withdrawn" more deeply than the edge of the gate electrode and the edge of the electron emission layer. In the above configuration, the distance from the edge of the gate electrode to the edge of the electron emission portion is mainly dependent upon the thickness of the second insulating layer, and it is far easier to control the above distance than to control the distance in the Spindt-type field emission device. Therefore, uniform electron emission characteristics of the electron emission portions can be accomplished even on the supporting substrate having a large area, and a uniform brightness of an image on a display can be also accomplished.

U.S. Pat. No. 5,214,347 discloses a structure in which not only a gate electrode is formed on the upper side of the electron emission layer but also a gate electrode is formed on the lower side of the electron emission layer so that a more intense electric field can be applied to the electron emission layer. That is, as shown in FIG. 18, a conductive layer 101, a first insulating layer 102, a lower gate electrode 103, a second insulating layer 104, an electron emission layer 105, a third insulating layer 106 and an upper gate electrode 107 are consecutively formed on a supporting substrate 100 to form a laminate, and an opening portion 108 is formed which penetrates through all the layers excluding the conductive layer 101 and has the conductive layer 101 exposed on a bottom thereof. Predetermined voltages are applied to the lower gate electrode 103, the electron emission layer 105 and the upper gate electrode 107 to generate an electric field, and due to the electric field, electrons e are emitted from the edge of the electron emission layer 105 projected on the wall surface of the opening portion 108. The emitted electrons are introduced out of the opening portion 108. The top of the edge of the electron emission layer 105 has its radius of curvature decreased by decreasing the thickness of the electron emission layer by isotropic etching, whereby the electron emission density is increased.

A conductive layer 109 disposed so as to face the upper gate electrode 107, the electron emission layer 105 and the lower gate electrode 103 constitutes an electrode for attracting electrons emitted from the electron emission layer 105. The conductive layer 101 exposed on the bottom of the opening portion 108 is provided for surface protection, potential stabilization and prevention of dielectric breakdown and a noise.

In the edge-type field emission device disclosed in U.S. Pat. No. 5,214,347, the electron emission layer 105 which constitutes electron emission portions can be formed nearly in the form of a flat plate or layer and unlike the above Spindt-type field emission device, it is not required to sharpen the electron emission portions three-dimensionally, so that the edge-type filed emission device can be easily produced as compared with the Spindt-type field emission device.

In the above edge-type field emission device, further, the distance from the edge of the gate electrode 103 or 107 to the edge of the electron emission layer 105 can be mostly determined on the basis of the thickness of the insulating layer 104 or 106. It is therefore far easier to control the above distances than it is in the Spindt-type field emission device. In this sense, the defects of the Spindt-type field emission device can be overcome to a considerable extent. The uniform electron emission characteristics of the electron emission portions can be therefore easily accomplished even on the supporting substrate having a large area, and a uniform brightness of an image on a display can be also accomplished.

The problem with the field emission device is that the electron emission characteristics of the electron emission portions vary. When the potential difference ΔV between a voltage applied to the gate electrode and a voltage applied to the electron emission layer comes to be greater than a certain threshold voltage, electrons are begun to be emitted from the edge of the electron emission layer. With an increase in the voltage applied to the gate electrode (i.e., an increase in the potential difference ΔV), an emission electron current I generated by the emission of electrons from the edge of the electron emission layer sharply increases. Further, when the emission electron current I exceeds a limit value $I_{MAX}$, the edge portion of the electron emission layer is destroyed.

The electron emission portions are formed on a cathode panel in a unit of as many as several hundred thousand to several hundred million under the same process, and even when field emission devices appear to be uniform through an electron microscope, the threshold voltages of the field emission devices vary. In such a state, field emission devices having characteristics $D_1$ and $D_2$ shown in V-I curves of FIG. 19B are destroyed by an overcurrent. Field emission devices having characteristics $D_3$ and $D_4$ emit electrons. However, field emission devices having characteristics $D_5$ and $D_6$ do not begin to emit electrons from edges of the electron emission layer since the potential difference is lower than the threshold voltage. In FIGS. 19A and 19B, the axis of abscissas indicates potential differences ΔV, and the axis of ordinates indicates emission electron currents I. When the threshold voltages of the field emission devices vary, some field emission devices emit electrons from the edges of the electron emission layer, and some do not, even if the potential difference is constant ΔV. Further, there are actually a potential variation in the range of several volts between adjacent lines, which consequently causes variation in brightness between the lines. It is assumed that the above potential variation and the threshold potential variation are caused by microscopical differences in surface states of the electron emission portions, while it is not necessarily clear what causes the above phenomena, and current production techniques inevitably involve them. There is also another problem that the electron emission characteristic of the electron emission portion comes to be non-uniform with the elapse of time. As a result, there is caused a problem that it is difficult to display clear images with a conventional field emission device or that images cannot be stably displayed.

OBJECT AND SUMMARY OF THE INVENTION

It is an object of the present invention to provide a cold cathode field emission device in which the change of the electron emission characteristic with the elapse of time is suppressed and which shows a uniform electron emission characteristic among a plurality of the cold cathode field emission devices, and a cold cathode field emission display in which the cold cathode field emission devices are incorporated.

According to a first aspect of the present invention, the above object is achieved by a cold cathode field emission device (to be sometimes referred to as "field emission device according to the first aspect of the present invention" hereinafter) comprising an electron emission layer, an insulating layer and a gate electrode which are laminated one on another with the insulating layer positioned between the gate electrode and the electron emission layer, and further comprising an opening portion which penetrates through at least the insulating layer and the electron emission layer, the electron emission layer having an edge portion for emitting electrons, the edge portion being projected on a wall surface of the opening portion, and the electron emission layer being connected to a power source through a resistance layer.

The field emission device according to the first aspect of the present invention preferably has a configuration in which the gate electrode comprises a first gate electrode and a second gate electrode, and the electron emission layer is formed so as to be sandwiched between the first gate electrode and the second gate electrode through a first insulating layer and a second insulating layer. In this configuration, since the electric field intensity can be increased with the first gate electrode, the second gate electrode and the electron emission layer, the field emission device can accomplish a high electron emission efficiency. The field emission device according to the first aspect of the present invention preferably has a configuration in which the resistance layer is formed in a region other than an overlapping region where the gate electrode and the electron emission layer overlap each other. In this configuration, no resistance layer having a high dielectric constant is arranged in a region where an electric field is generated, and a capacitance between wirings (i.e., stray capacitance) can be decreased.

According to a second aspect of the present invention, the above object of the present invention is achieved by a cold cathode field emission device (to be sometimes simply referred to as "field emission device according to the second aspect of the present invention) comprising;

(A) a first gate electrode formed on a supporting substrate, (B) a first insulating layer formed on the supporting substrate and the first gate electrode, (C) an electron emission layer formed on the first insulating layer, (D) a wiring formed on the first insulating layer, (E) a second insulating layer formed on the first insulating layer, the electron emission layer and the wiring, (F) a second gate electrode formed on the second insulating layer, and (G) an opening portion which penetrates through the second gate electrode, the second insulating layer, the electron emission layer and the first insulating layer and has a bottom portion on which a surface of the first gate electrode is exposed, the electron emission layer having an edge portion for emitting electrons, the edge portion being projected on a wall surface of the opening portion, and the wiring and the electron emission layer being electrically connected to each other with a resistance layer.

In the present specification, the terms "project" or "projected" are each used as a term for a direction toward a space formed by the opening portion, and the terms "withdraw" or withdrawn are each used as a term for a direction out of the space formed by the opening portion.

The field emission device according to the second aspect of the present invention preferably has a configuration in which the first gate electrode is connected with the first gate electrode of the adjacent field emission device through a first gate electrode extending portion, the first gate electrode including the first gate electrode extending portion has the form of a stripe when viewed as a plan view, the second gate electrode is connected with the second gate electrode of the adjacent field emission device through a second gate electrode extending portion, the second gate electrode including the second gate electrode extending portion has the form of a stripe when viewed as a plan view, the wiring has an outer form similar to a stripe when viewed as a plan view, two members of the first gate electrode with the first gate electrode extending portion, the wiring, the second gate electrode with the second gate electrode extending portion extend in a first direction, and the remaining member extends in a second direction different from the first direction, and the resistance layer is formed in a region other than an overlapping region where the first gate electrode, the electron emission layer and the second gate electrode are overlapped when viewed from the direction of the normal of the supporting substrate. In this configuration, no resistance layer having a high dielectric constant is arranged in a region where an electric field is generated, and a capacitance between the wirings (stray capacitance) can be decreased.

An embodiment in which two members of the first gate electrode with the first gate electrode extending portion (these will be sometimes generically referred to as "stripe-shaped first gate electrode" hereinafter), the wiring, the second gate electrode with the second gate electrode extending portion (these will be sometimes generically referred to as "striped-shaped second gate electrode" hereinafter) extend in the first direction, and the remaining member extends in the second direction different from the first direction includes;

(1) an embodiment in which both the stripe-shaped first gate electrode and the stripe-shaped second gate electrode extend in the first direction, and the wiring extends in the second direction different from the first direction, (2) an embodiment in which both the stripe-shaped first gate electrode and the wiring extend in the first direction, and the stripe-shaped second gate electrode extends in the second direction different from the first direction, and (3) an embodiment in which both the wiring and the stripe-shaped second gate electrode extend in the first direction, and the stripe-shaped first gate electrode extends in the second direction different from the first direction.

The first direction and the second direction may form any angle so long as the overlapping region can be effectively formed. Most preferably, however, they cross each other at right angles in view of the integration density of the field emission devices.

In the above case, there may be employed a configuration in which the electron emission layer has a form of an island when viewed as a plan view, and the wiring surrounds the electron emission layer. Further, it is preferred to employ a configuration in which the resistance layer is formed on the electron emission layer, on the wiring and on the first insulating layer.

In the field emission device according to the second aspect of the present invention, there may be also employed a configuration in which a third insulating layer is formed on the second insulating layer and the second gate electrode, a focus electrode is formed on the third insulating layer, and the third insulating layer is provided with a second opening portion communicating with the above opening portion. In the above configuration, preferably, the focus electrode and the electron emission layer are electrically connected.

The focus electrode is an optional member for focussing the track or orbit of electrons moving toward an anode electrode when the field emission devices of the present invention are incorporated into a cold cathode field emission display and therefore making it possible to improve a brightness and to prevent electrons from colliding with nontarget anode electrodes, and it is particularly effective when the display has a relatively large distance between a cathode panel and an anode panel. It is not necessarily required to form the focus electrode for every field emission device. For example, when it is formed along a predetermined alignment direction of the field emission devices, a common focusing effect can be worked on a plurality of the field emission devices. The second opening portion formed in the third insulating layer is therefore not necessarily required to be formed in a material layer constituting the focus electrode. The focus electrode generally has a potential similar to, or equal to, the potential of the electron emission layer, and when the edge of the focus electrode is projected into the second opening portion, electrons may be emitted from the focus electrode to the first gate electrode or the second gate electrode. Particularly preferably, therefore, the focus electrode is formed such that it is not projected into the second opening portion. Further, it is preferred to project the top end portion of the second gate electrode into the opening portion and the second opening portion for increasing the electric field intensity. The form of the second opening portion when viewed as a plan view may be congruous with, analogous to, or different from, the plane form of the opening portion, depending upon the configuration of the focus electrode.

The resistance layer works to decrease the variation or deviation of the electron emission characteristics among the field emission devices. In the field emission device according to the first or second aspect of the present invention, the electric resistance value of the resistance layer is $1\times10^5$ to $5\times10^7$ Ω, preferably $1\times10^5$ to $1\times10^7$ Ω, and more preferably 1 MΩ to several MΩ, which is a value at which a voltage drop of 1 volt to several volts can be expected under a current of 1 μA. The material for forming the resistance layer includes semiconductor materials such as amorphous silicon, oxides such as tantalum oxide, nitrides such as tantalum nitride, and carbide. In the field emission device according to the first or second aspect of the present invention, preferably, the resistance layer is composed of a material whose electric resistance value is not much affected by a thermal change and is not much changed by temperatures. Specifically, the temperature coefficient of the electric resistance value α of the resistance layer is preferably ±100 ppm/° C. or smaller. The material for forming such a resistance layer includes tantalum nitride (TaN) and carbides such as silicon carbide (SiC). The resistance layer may be formed of a mono-layer or a plurality of layers. When the resistance layer is a stacked layer or is formed of a plurality of layers by combining materials having proper temperature coefficients of the electric resistance value α, there can be easily formed a resistance layer having a desired electric resistance value and a desired temperature coefficient of the electric resistance value α. The temperature coefficient of the electric resistance value a can be expressed by the following equation, $$\alpha=(\rho-\rho_0)/\{\rho_0(T-T_0)\}\times10^6 \text{ ppm/° C.}$$

in which $\rho_0$ is an electric resistance value at $T_0$° C. (for example, 0° C.) and ρ is an electric resistance value at T° C. "T° C." is a maximum temperature (for example, 550 ° C.) to which the resistance layer is exposed when the field emission devices are produced.

In the field emission device according to the second aspect of the present invention, the resistance layer can be connected to the electron emission layer and the wiring by forming an insulating interlayer on the first insulating layer, the electron emission layer and the wiring, forming holes in the insulating interlayer and embedding the holes with the resistance layer similarly to the connection in multi-layered wiring in the field of production of semiconductor devices, while the above connection may be made from the surface of the electron emission layer to the surface of the wiring through the surface of the first insulating layer with the resistance layer. In the configuration in which the electron emission layer and the wiring is directly connected to each other with the resistance layer on the first insulation layer, it is no longer necessary to form the insulating interlayer on the electron emission layer and so on, nor is it necessary to make any hole for forming the contact holes. Therefore, not only the production process of the field emission device can be simplified to a great extent, but also a space for the connection can be decreased, and the above configuration is also preferred in view of an increase in the integration degree.

When viewed from a production process, the above formation of the resistance layer from the surface of the wiring to the surface of the electron emission layer through the surface of the first insulation layer, i.e., the formation of the resistance layer on the surfaces of the electron emission layer, the wiring and the first insulation layer means that it is required to pattern the resistance layer directly on the wiring, the electron emission layer and the first insulating layer. For carrying out the above patterning by an etching method, it is required to select a material showing a higher etching rate to a specific etching species than the electron emission layer, the wiring and the first insulating layer, as a material for the resistance layer. The "specific etching species" as used herein means an etching species for etching the resistance layer. For example, when silicon oxide ($SiO_2$) is selected for a material for the first insulating layer, when tungsten (W) is selected as a material for the electron emission layer and the wiring, and when amorphous silicon is selected as a material for the resistance layer, a fluorine-containing etching species or a chlorine-containing etching species is used as etching species for dry etching, whereby the resistance layer can be etched to a pattern in a desired form while retaining a high selectivity ratio to the electron emission layer, the wiring and the first insulating layer as undercoats. In another method, the resistance layer can be formed by a screen printing method using a resistant paste. Further, it can be also formed by a general thin-film formation process such as a vapor deposition method, a sputtering method, a chemical vapor deposition (CVD) method or an ion-plating method.

According to the present invention, the above object of the present invention is achieved by a cold cathode field emission display (to be sometimes simply referred to as "display" hereinafter), which has a plurality of pixels, each pixel comprising a cold cathode field emission device, and an anode electrode and a fluorescent layer formed on a substrate so as to face the cold cathode field emission device, each cold cathode field emission device comprising;

(A) a first gate electrode formed on a supporting substrate, (B) a first insulating layer formed on the supporting substrate and the first gate electrode, (C) an electron emission layer formed on the first insulating layer, (D) a wiring formed on the first insulating layer, (E) a second insulating layer formed on the first insulating layer, the electron emission layer and the wiring, (F) a second gate electrode formed on the second insulating layer, and (G) an opening portion which penetrates through the second gate electrode, the second insulating layer, the electron emission layer and the first insulating layer and has a bottom portion on which a surface of the first gate electrode is exposed, the electron emission layer having an edge portion for emitting electrons, the edge portion being projected on a wall surface of the opening portion, and the wiring and the electron emission layer being electrically connected to each other with a resistance layer.

The cold cathode field emission device in the display of the present invention can include all of the above various embodiments and the configurations of the field emission device according to the second aspect of the present invention.

In the display of the present invention, one pixel may comprise one field emission device, or one pixel may comprise a plurality of the field emission devices.

In the present invention, the opening portion may have a circular form when viewed as a plan view, like the conventional Spindt-type field emission device. In view of the structure of the edge-type field emission device in which the electron emission layer (i.e., that edge portion of the electron emission layer which is projected on the wall surface of the opening portion) can be formed along the wall surface of the opening portion, the above form of the opening portion may be any form including a circle, an ellipse, a polygon having N sides wherein N is an integer of 3 or more. The polygon having N sides is not required to be a regular polygon, and the vertices of the polygon may be rounded. For example, the opening portion is formed in the form of a rectangle having a large aspect ratio or a groove, and the electron emission layer whose edge portion is projected on the wall surface of the opening portion can be arranged along the longitudinal direction of the rectangle.

In the field emission device according to the second aspect of the present invention, the edge portion of the electron emission layer can be projected on the wall surface of the opening portion by forming the opening portion and then etching the first insulating layer and the second insulating layer under an isotropic condition. Otherwise, it can be formed by forming an opening portion so as to penetrate through the second insulating layer and then etching the second insulating layer under an isotropic condition, and by forming an opening portion so as to penetrate through the first insulating layer and then etching the first insulating layer under an isotropic condition. In these manners, the edge portion of the electron emission layer comes to be projected on the opening-portion-forming surface of the first insulating layer and on the opening-portion-forming surface of the second insulating layer, and electrons can effectively be emitted by concentrating an electric field formed in the opening portion by the first gate electrode and the second gate electrode onto the edge portion of the electron emission layer. The etching under isotropic etching can be carried out, typically, by wet etching or under a dry etching condition where radicals constitute a main etching species. In this case, the length of the edge portion of the electron emission layer, i.e., the withdrawal amount of the first insulating layer and the second insulating layer can be controlled by adjusting the time period for the etching.

In the present invention, the material for the gate electrode (or the first gate electrode and the second gate electrode) or the focus electrode includes metals such as tungsten (W), niobium (Nb), tantalum (Ta), molybdenum (Mo), chromium (Cr), aluminum (Al) and copper (Cu), alloys containing these metals, any one of compounds of these metals and semiconductors such as silicon (Si). These electrodes may be composed of the same material, materials of the same type or materials of different types. These electrodes can be formed by a general thin-film-forming method such as a vapor deposition method, a sputtering method, a CVD method, an ion-plating method, a printing method, a plating method or the like.

The electron emission layer can be formed, typically, from tungsten (W), tantalum (Ta), titanium (Ti), molybdenum (Mo), chromium (Cr), niobium (Nb), alloys containing these metals, any one of compounds of these metals (for example, nitrides such as TiN and silicides such as $WSi_2$, $MoSi_2$, $TiSi_2$ and $TaSi_2$), or a semiconductor such as diamond. The electron emission layer can be formed by a general thin-film-forming method such as a vapor deposition method, a sputtering method, a CVD method, an ion-plating method, a printing method, a plating method or the like. The thickness of the electron emission layer is approximately 0.05 to 0.5 $\mu$m, preferably 0.1 to 0.3 $\mu$m, while not limited to the above range.

In the present invention, the supporting substrate or the substrate may be any substrate so long as its surface is composed of a material having insulating properties. The supporting substrate or the substrate includes a glass substrate, a glass substrate having a surface formed of an insulating film, a quartz substrate, a quartz substrate having a surface formed of an insulating film, and a semiconductor substrate having a surface formed of an insulating film. In some cases, the substrate is required to have transparency depending upon a configuration of the cold cathode field emission display.

The material for the insulating layer, the first insulating layer, the second insulating layer or the third insulating layer can be selected from $SiO_2$, SiN, SiON, or a glass-paste cured product. These materials can be used alone or by laminating them as required. The insulating layer can be formed by a known method such as a CVD method, an application method, a sputtering method or a printing method.

In the present invention, the electron emission layer is connected to a power source through the resistance layer, or the wiring and the electron emission layer are connected to each other through the resistance layer. As shown in the V-I curve of FIG. 19A, therefore, the slant of the straight line portion of the V-I curve becomes moderate as compared with a case using no resistance layer. In all of the field emission devices having characteristics $D_1$ to $D_6$, electrons are emitted at a potential difference $\Delta V_0$, and no destruction occurs due to an overcurrent. Even if the threshold voltages of the field emission devices vary, electrons can be emitted from edge portions of all the field emission devices at the same potential difference $\Delta_0$.

Further, when electrons emitted from some field emission device increase in quantity, a large voltage drop arises in the resistance layer. As a result, the potential difference between the gate electrode and the electron emission layer decreases, and electrons to be emitted from the edge portion of the electron emission layer are suppressed in terms of the number thereof. When electrons emitted from some field emission device decrease, a small voltage drop arises in the resistance layer. As a result, the potential difference between the gate electrode and the electron emission layer increases, and electrons to be emitted from the edge portion of the electron emission layer increase in number.

As described above, the resistance layer works to decrease the variation or deviation of the electron emission characteristics among the field emission devices. Further, even when a constant voltage is applied to the electron emission layer of the field emission device, the current flowing in the electron emission layer sometimes fluctuates. The resistance layer can suppress the fluctuation of the current flowing in the electron emission layer in the above case as well.

If the resistance layer is composed of a material whose electric resistance value is not much affected by a thermal change and is not much changed by temperatures, for example, a material having a temperature coefficient of the electric resistance value a of ±100 ppm/° C. or smaller, there can be obtained a cold cathode field emission device or a cold cathode field emission display having a far more excellent electron emission characteristic.

BRIEF DESCRIPTION OF THE DRAWINGS

The present invention will be explained in detail with reference to drawings hereinafter.

FIG. 7B, are schematic partial end views of the supporting substrate, and so forth, for explaining the process of production of the cold cathode field emission device in Example 2.

FIG. 8B, are schematic partial end views of the supporting substrate, and so forth, for explaining the process of production of the cold cathode field emission device in Example 2.

FIG. 9B, are schematic partial end views of the supporting substrate, and so forth, for explaining the process of production of the cold cathode field emission device in Example 2.

DESCRIPTION OF THE PREFERRED EMBODIMENTS

EXAMPLE 1

Figure 1:
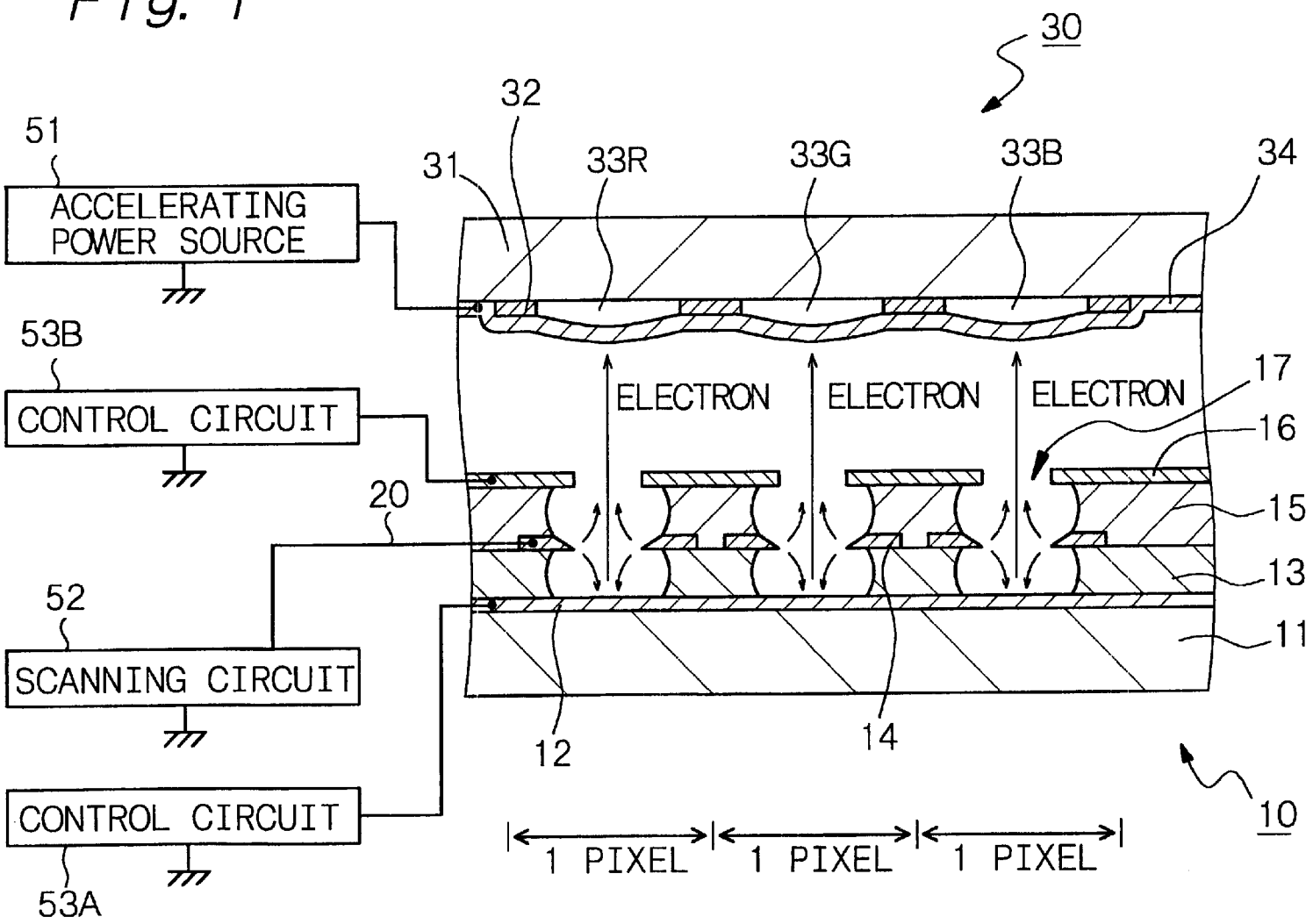
FIG. 1 is a schematic partial end view of a cold cathode field emission display in Example 1.
Figure 2:
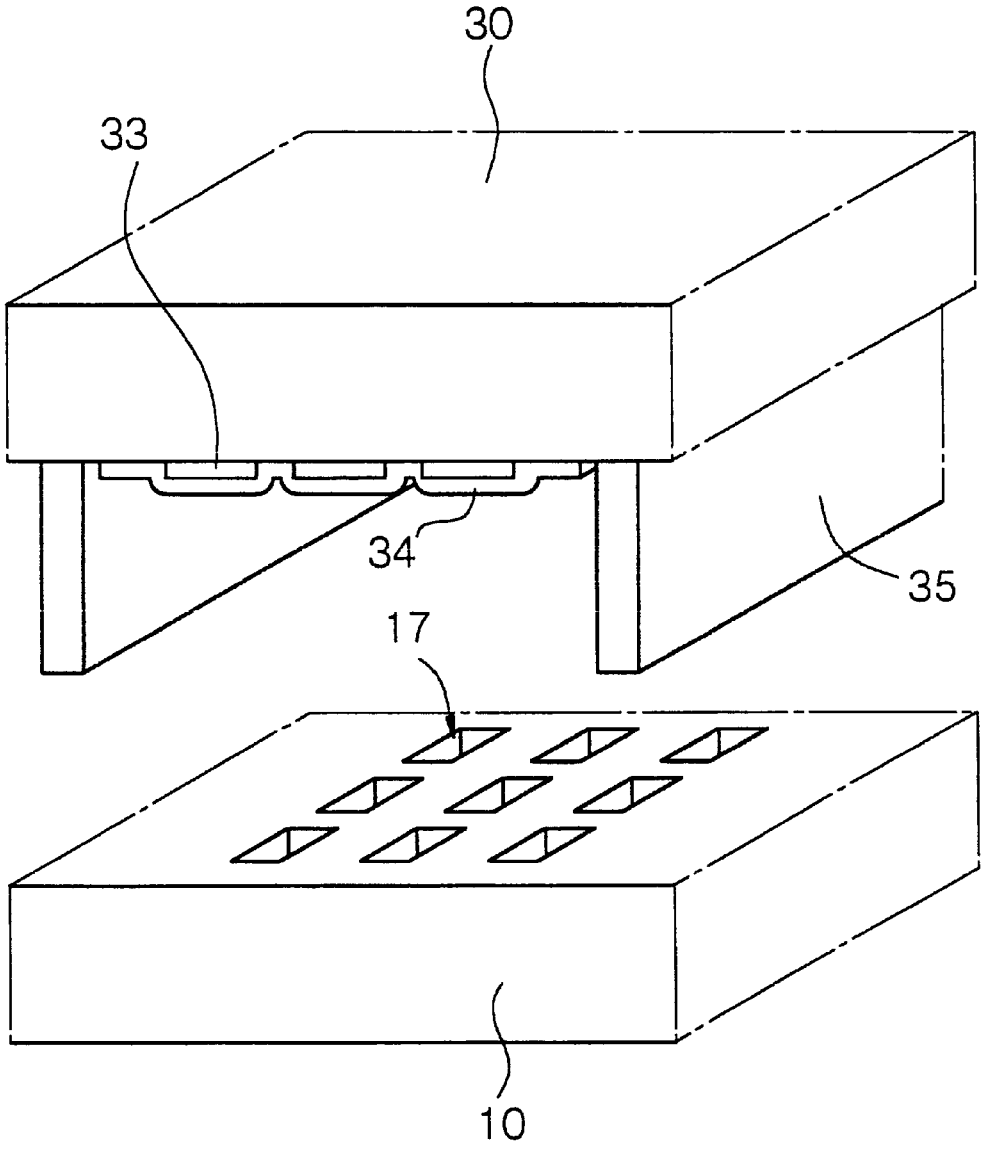
FIG. 2 is a conceptual view of the cold cathode field emission display in Example 1.
Figure 3:
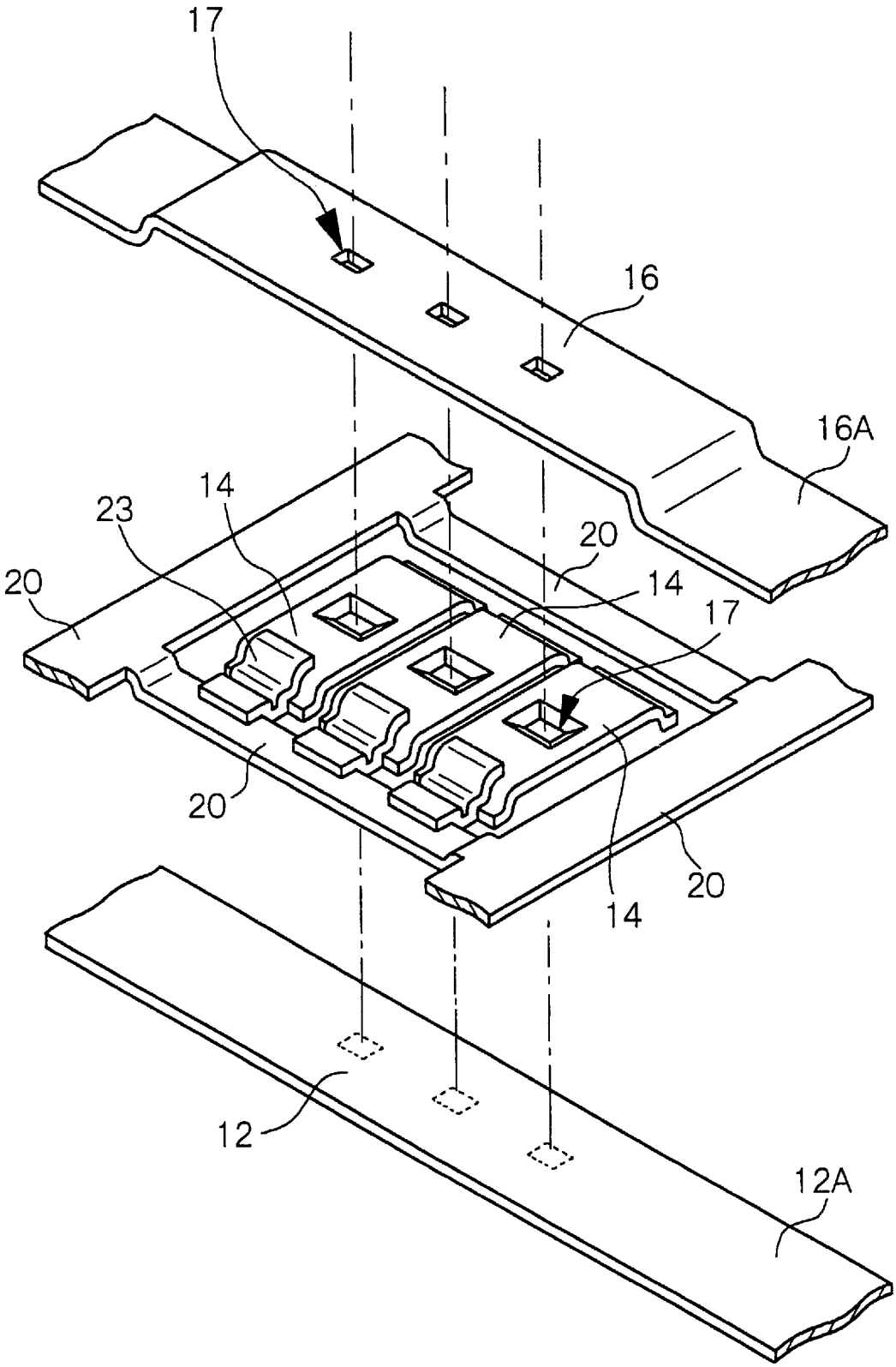
FIG. 3 is an exploded perspective view of the cold cathode field emission devices in Example 1 in the vicinity of the opening portions.
Figure 4:
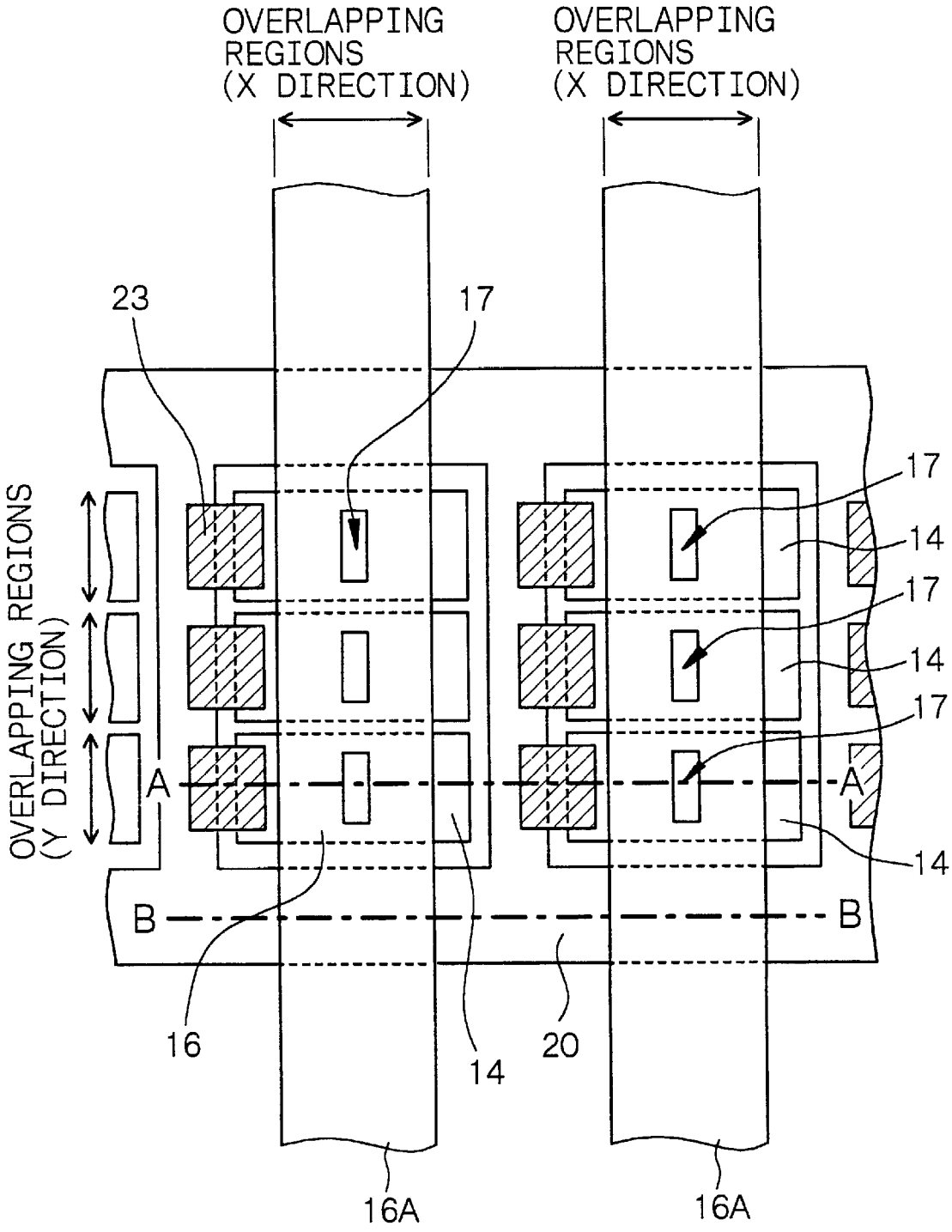
FIG. 4 is a schematic configuration of elements in the vicinity of the opening portions of the cold cathode field emission devices in Example 1.
Figure 5A:
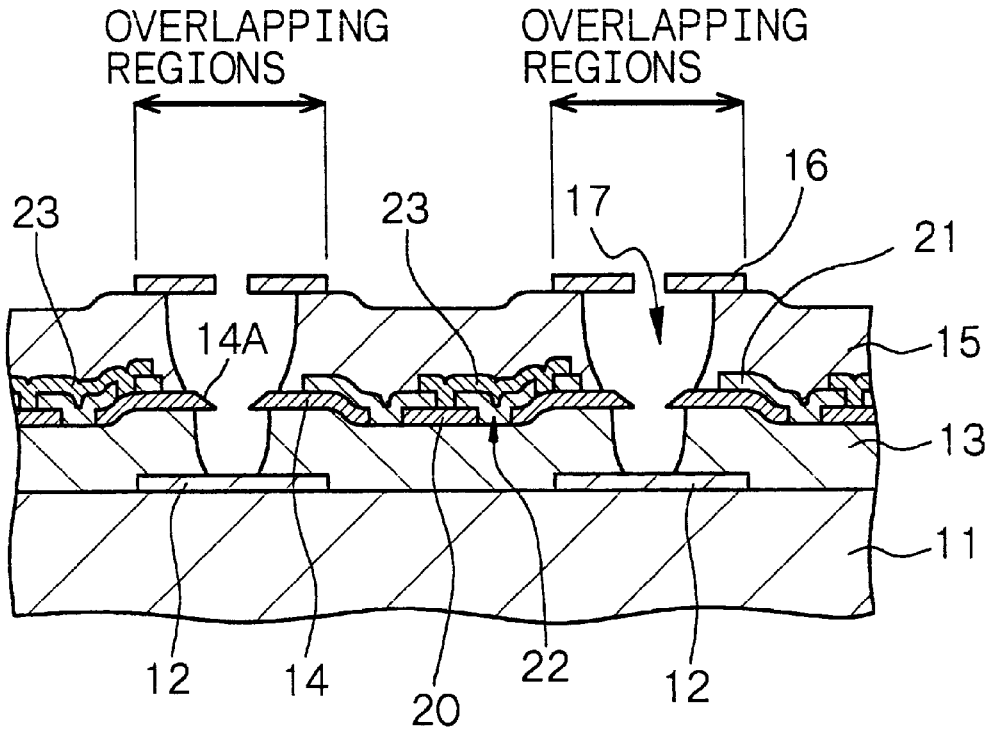
FIGS. 5A and 5B are schematic partial end views of the cold cathode field emission devices in Example 1, which are taken along lines A—A and B—B in FIG. 4.
Figure 5B:
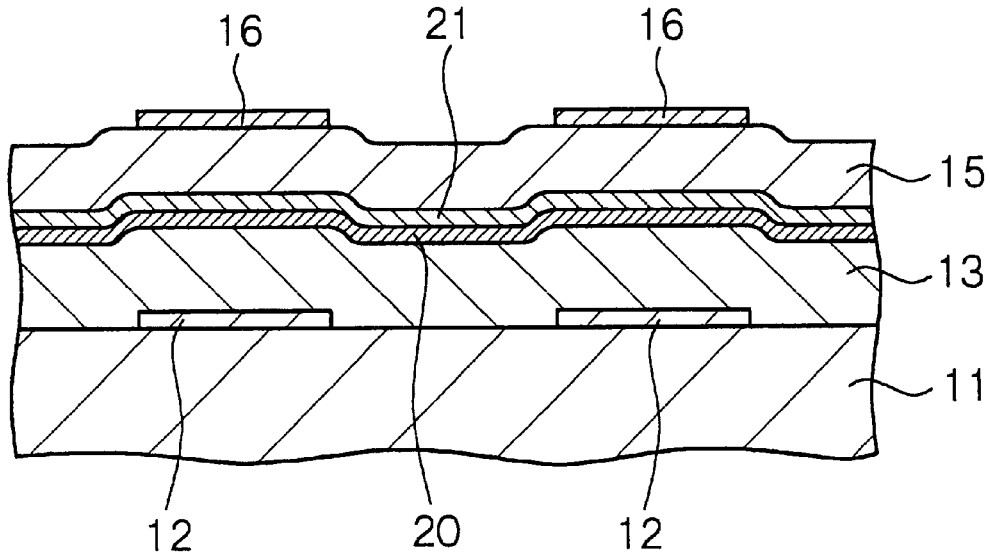

Example 1 is concerned with the field emission device according to the first and second aspects of the present invention, and the display of the present invention. FIG. 1 shows a schematic partial end view of the display in Example 1, and FIG. 2 shows a conceptual view thereof. FIG. 3 shows an exploded perspective view of the field emission devices in the vicinity of the opening portions, and FIG. 4 schematically shows a configuration of elements of the field emission devices in the vicinity of the opening portions, and FIGS. 5A and 5B show schematic partial end views of the field emission devices taken along lines A—A and B—B in FIG. 4. In FIGS. 3 and 4, a supporting substrate and all of insulating layers are omitted for the convenience of showing.

The field emission device in Example 1 has a supporting substrate 11 made of, for example, a glass substrate, a first gate electrode 12, a first insulating layer 13, an electron emission layer 14, a wiring 20, a second insulating layer 15, a second gate electrode 16 and an opening portion 17. The first gate electrode 12 is formed on the supporting substrate 11, and the first insulating layer 13 is formed on the substrate 11 and the first gate electrode 12. The electron emission layer 14 and the wiring 20 are formed on the first insulating layer 13. Further, the second insulating layer 15 is formed on the first insulating layer 13, the electron emission layer 14 and the wiring 20. The second gate electrode 16 is formed on the second insulating layer 15. The opening portion 17 penetrates through the second gate electrode 16, the second insulating layer 15, the electron emission layer 14 and the first insulating layer 13, and a surface of the first gate electrode 12 is exposed in the bottom thereof. The electron emission layer 14 has an edge portion 14A projected on a wall surface of the opening portion 17, and electrons are emitted from the edge portion 14A. The opening portion 17 has a nearly rectangular form when viewed as a plan view.

Otherwise, the field emission device of Example 1 comprises the electron emission layer 14, an insulating layer and a gate electrode which are laminated one on other with the insulating layer positioned between the gate electrode and the electron emission layer 14, and further comprises an opening portion which penetrates through at least the insulating layer and the electron emission layer 14, and electrons are emitted from the edge portion 14A of the electron emission layer 14, the edge portion 14A being projected on the wall surface of the opening portion 17. In Example 1, the electron emission layer 14 is connected to a power source (for example, a scanning circuit) through a resistance layer 23 (FIG. 3). The gate electrode comprises the first gate electrode 12 and the second gate electrode 16, and the electron emission layer 14 is arranged to be sandwiched between the first gate electrode 12 and the second gate electrode 16 through the first insulating layer 13 and the second insulating layer 15.

The edge portion 14A (FIG. 5A) of the electron emission layer 14 is a portion which works as an electron emission portion, and it has a sharpened form. Specifically, the edge portion 14A projected on the wall surface of the opening portion 17 has a thickness which decreases toward its end portion and toward a lower side of the opening portion 17 from an upper side of the opening portion 17. Further, the top end portion (edge) of the second gate electrode 16 is projected on the second insulating layer 15. That is, the upper end portion of the opening portion 17 formed in the first insulating layer 13 is withdrawn more deeply than the edge portion 14A of the electron emission layer 14. Further, the lower end portion of the opening portion 17 formed in the second insulating layer 15 is withdrawn more deeply than the edge portion 14A of the electron emission layer 14, and the upper end portion of the opening portion 17 formed in the second insulating layer 15 is withdrawn more deeply than the top end portion of the second gate electrode 16. In other words, the opening portion formed in the electron emission layer 14 has smaller opening dimensions than the opening portion formed in the first insulating layer 13 and the opening portion formed in the second insulating layer 15, and the opening portion formed in the second gate electrode 16 has smaller opening dimensions than the opening portion formed in the second insulating layer 15.

The first gate electrode 12 and the second gate electrode 16 extend in the form of a stripe in the direction perpendicular to the paper surface of the FIGS. 5A and 5B (row direction of the display) and are in common with the first gate electrodes 12 and the second gate electrodes 16 of the adjacent field emission devices, respectively. That is, the first gate electrodes 12 of a plurality of the field emission devices are mutually electrically connected through the first gate electrode extending portions 12A. The second gate electrodes 16 of a plurality of the field emission devices are mutually electrically connected through the second gate electrode extending portions 16A. Further, the wiring 20 extends in the form of a stripe in the lateral direction of the paper surface of FIGS. 5A and 5B (i.e., a column direction of the display) and connects the electron emission layers 14 of the adjacent field emission devices. That is, the electron emission layers 14 of a plurality of the field emission devices are mutually electrically connected with the wiring 20. The stripe-shaped first gate electrode 12 and the stripe-shaped second gate electrode 16 similarly extend in parallel in the first direction (a Y direction in the Figures), and the wiring 20 extends in the second direction (an X direction in the Figures). That is, the stripe-shaped first gate electrode 12 and the stripe-shaped second gate electrode 16 extend so as to cross the wiring 20 at right angles. In FIG. 4, the showing of the stripe-shaped first gate electrode 12 formed below the stripe-shaped second gate electrode 16 is omitted.

The electron emission layer 14 is sandwiched between the first gate electrode 12 and the second gate electrode 16. A portion where the electron emission layer 14, the first gate electrode 12 and the second gate electrode 16 overlap is an overlapping region, and rectangular regions where X-direction and Y-direction cross each other in FIG. 4 refer to overlapping regions.

The wiring 20 and the electron emission layer 14 are electrically connected to each other through the resistance layer 23 composed of an amorphous silicon containing impurities so as to have an electric resistance value of $10^5$ to $10^7$ Ω. The temperature coefficient of the electric resistance value α of the above amorphous silicon is approximately 30 ppm/° C. When the device is viewed from the normal of the supporting substrate 11, the resistance layer 23 is present in a region other than the overlapping region where the first gate electrode 12, the electron emission layer 14 and the second gate electrode 16 overlap. The region other than the overlapping region will be referred to as an outer region for convenience. Therefore, a capacitance or stray capacitance between the first gate electrode 12 and the wiring 20 and a capacitance or stray capacitance between the second gate electrode 16 and the wiring 20 increase in no case. As a result, the field emission device can be driven at a relatively small stray capacitance. In, the field emission device, the disadvantage of a delay in driving signals caused by an increase in the stray capacitance can be reliably prevented, and the load on the electric circuit of the display does not increase. Further, there are not any problems that the in-plane uniformity and the image quality of the display are downgraded, either.

The electron emission layer 14 has an island-shaped rectangular form, is positioned in the overlapping region, and surrounds the opening portion 17. Further, the wiring 20 surrounds the electron emission layer 14. In the field emission devices of Example 1, one set of three electron emission layers 14 arranged in parallel are surrounded by the wiring 20, while the form and the number of the electron emission layers 14 surrounded by the wiring 20 shall not be limited thereto. As shown in FIG. 5A, an insulating interlayer 21 is formed on the electron emission layer 14 and the wiring 20, more specifically, on the electron emission layer 14, the wiring and the first insulating layer 13. Further, the resistance layer 23 is formed on the insulating interlayer 21. Hole portions 22 are formed in the insulating interlayer 21 above the electron emission layer 14 and the wiring 20, and the resistance layer 23 is embedded in the hole portions 22. The material for the insulating interlayer 21 may be the same as the material for the first insulating layer 13 or the second insulating layer 15, such as $SiO_2$, while the insulating interlayer 21 is preferably composed of, for example, SiN by taking account of humidity resistance and the like. When a material, such as SiN, having etching characteristics different from those of $SiO_2$ is used, it is required to form a pattern which excludes a region where the opening portion 17 is to be formed, as shown in the Figures, so that the withdrawal of the wall surface of the opening portion 17 and the sharpening of edge portion of the electron emission layer 14 can be performed as desired. In the outer region, as shown in FIG. 5B, it is not required to pattern the insulating interlayer 21 in particular.

The display of Example 1 has a plurality of pixels as shown in FIG. 1. Each pixel comprises one or a plurality of the above field emission device(s), and an anode electrode 34 and fluorescence layers 33R, 33G and 33B formed on a substrate 31 so as to face the field emission device(s). The anode electrode 34 of, for example, aluminum is formed on the substrate 31 made of a transparent glass so as to have a stripe-shaped pattern and so as to cover the fluorescence layers 33R, 33G and 33B which are alternately formed. The fluorescence layer 33R is a layer for emitting red light, the fluorescence layer 33G is a layer for emitting green light, and the fluorescence layer 33B is a layer for emitting blue light. Black matrices 32 composed of a light-absorbing material such as carbon are embedded between the fluorescence layers 33R, 33G and 33B, so that mixing of the color in displayed images can be prevented. For the simplification of explanations, the fluorescence layers 33R, 33G and 33B are generically simply referred to as fluorescence layer(s) 33 hereinafter. The opening portions 17 constituting the field emission devices are formed in the form of a matrix so as to face the fluorescence layer 33. The fluorescence layers 33 and the anode electrode 34 on the substrate 31 may be formed in an order reverse to the above-described order. In this case, the anode electrode 34 is positioned before the fluorescence layer 33 when these are viewed from a display viewing side. It is therefore required to use a transparent electrically conductive material such as ITO (indium-tin oxide) to form the anode electrode 34. Further, each pixel has one opening portion 17 or a combination of a plurality of the opening portions 17. Reference numeral 35 (see FIG. 2) indicates a pillar, which spaces the cathode panel 10 and the anode panel 30 at a predetermined interval.

In the configuration of the actual display, the field emission device is an element constituting the cathode panel 10, and the anode electrode 34 and the fluorescence layer 33 are elements constituting the anode panel 30. The cathode panel 10 and the anode panel 30 are bonded to each other with a frame and a frit glass (not shown), and a space surrounded by these panels and the frame is evacuated to a high degree of vacuum. The first gate electrode 12 and the second gate electrode 16, specifically, the first gate electrode extending portion 12A and the second gate electrode extending portion 16A are connected to control circuits 53A and 53B in an end portion of the display in the row direction, respectively. The wiring 20 is connected to a scanning circuit 52 (corresponding to a power source) in an end portion of the display in the column direction.

A relative negative voltage (for example, 0 volt) is applied to the electron emission layer 14 from the scanning circuit 52 through the wiring 20 and the resistance layer 23. A relative positive voltage (for example, pulse-like signal voltage of approximately 50 to 80 volts) is applied to the first gate electrode 12 from the control circuit 53A, a positive voltage (for example, 30 volts) is applied to the second gate electrode 16 from the control circuit 53B, and a positive voltage (for example, 0.3 to 10 kilovolts) higher than the voltages applied to the first gate electrode 12 and the second gate electrode 16 is applied to the anode electrode 34 from an accelerating power source 51. When displaying is performed in the display, video signals are inputted to the control circuits 53A and 53B, and scanning signals are inputted to the scanning circuit 52. When the voltages are applied to the first gate electrode 12, the second gate electrode 16 and the electron emission layer 14, an electric field is generated, and due to the generated electric field, electrons are emitted from the edge portion 14A of the electron emission layer 14. The emitted electrons are attracted directly to the anode electrode 34 depending upon the voltages applied to the first gate electrode 12 and the second gate electrode 16. Otherwise, the emitted electrons are attracted to, and collide with, the first gate electrode 12 to generate reflected electrons and/or secondary electrons on the first gate electrode 12. These reflected electrons and/or secondary electrons are attracted to the anode electrode 34. The field emission devices arranged in the form of a matrix are consecutively driven as described above, whereby the fluorescence layers 33 constituting the pixels can be consecutively allowed to emit light and desired images can be displayed.

As described above, in the field emission device, the electron emission layer 14 is connected to the power source through the resistance layer 23, or the wiring 20 and the electron emission layer 14 are electrically connected through the resistance layer 23. The field emission device therefore constantly exhibits the stable electron emission characteristic. Therefore, the change of electron emission characteristic of the field emission device with the elapse of time can be prevented, and electrons can be constantly emitted in a desired quantity.

EXAMPLE 2

Figure 6A:
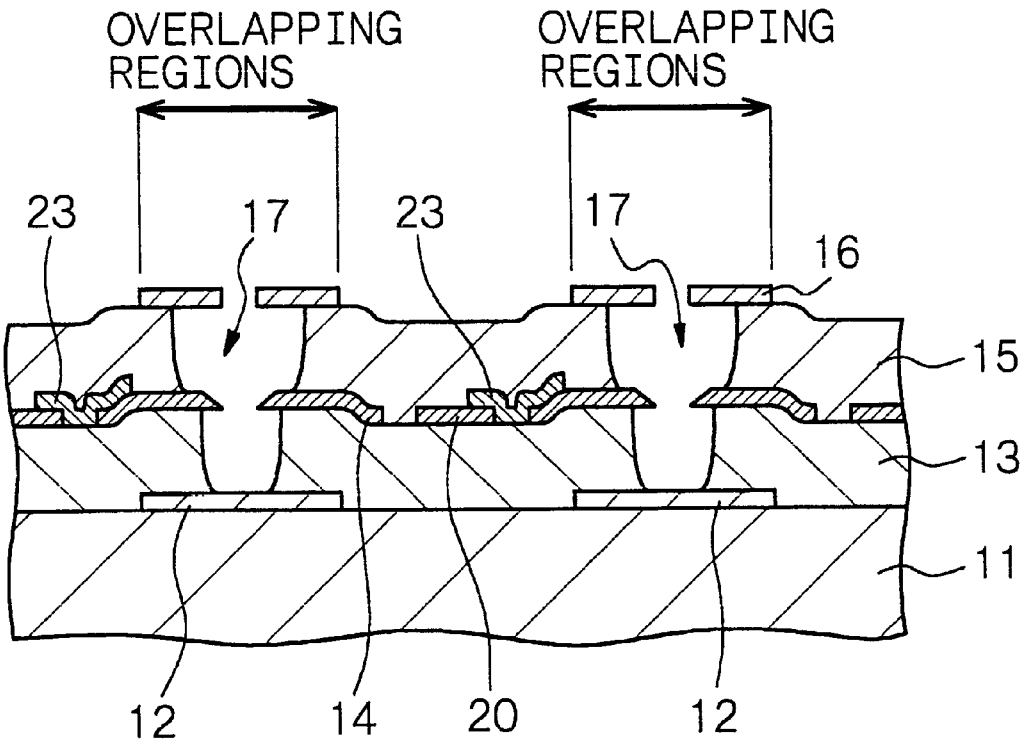
FIGS. 6A and 6B are schematic partial end views of a cold cathode field emission device in Example 2, which are taken along lines similar to lines A—A and B—B in FIG. 4.
Figure 6B:
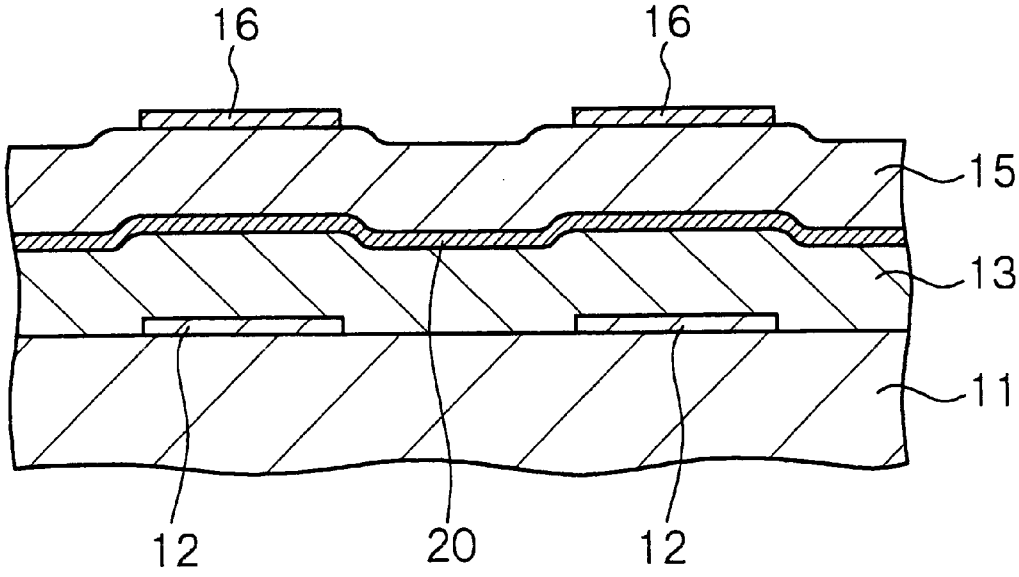

Example 2 is a variant of Example 1. The field emission device and the display of Example 2 differ from the counterparts of Example 1 in that the insulating interlayer 21 is omitted and that the resistance layer 23 is not formed on the insulating interlayer 21 but is formed on the electron emission layer 14, the wiring 20 and the first insulating layer 13. FIGS. 6A and 6B show schematic partial end views of the field emission device taken along lines similar to lines A—A and B—B in FIG. 4.

As shown in FIGS. 6A and 6B as well, the resistance layer 23 is directly patterned on the electron emission layer 14 and the wiring 20. The first insulating layer 13 is exposed between the electron emission layer 14 and the wiring 20 (see FIG. 6A), and the resistance layer 23 is formed on the surfaces of the first insulating layer 13, the electron emission layer 14 and the wiring 20. The connection in the above configuration can be accomplished in fewer steps than the connection through the contact hole formed in the insulating layer 21, and further, the above connection can advantageously serve to the formation of finer and higher-integration of the field emission devices by decreasing the length of the connection. The other configurations are the same as those in Example 1, and explanations thereof are omitted.

The process for the production of the field emission device in Example 2 will be explained with reference to FIGS. 7A, 7B, 8A, 8B, 9A, 9B, 10A and 10B hereinafter. These Figures typically show only cross sections including the overlapping region.

[Step-100]

Figure 7A:
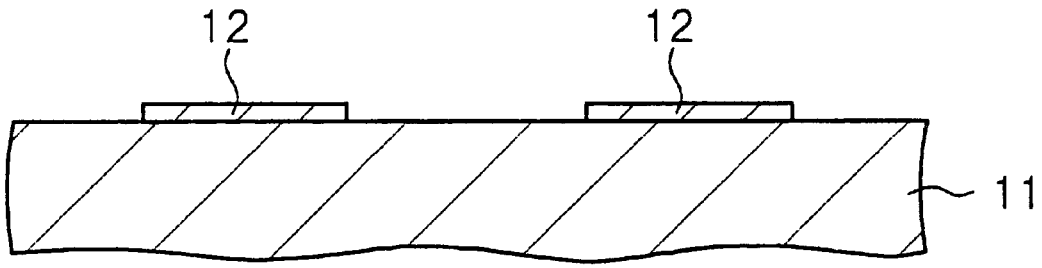
FIGS. 7A and 7B are schematic partial end views of a supporting substrate, and so forth, for explaining the process of production of the cold cathode field emission device in Example 2.

As shown in FIG. 7A, first, a tungsten film having a thickness of approximately 0.05 to 0.3 $\mu$m is formed, by a sputtering method, on a supporting substrate 11 made of, for example, a glass substrate, and the tungsten film is patterned by a conventional lithography method and a dry etching method to form a first gate electrode 12 and a first gate electrode extending portion 12A (not shown in FIG. 7A). The first gate electrode 12 including the first gate electrode extending portion 12A extends in the Y-axis direction.

[Step-110]

Figure 7B:
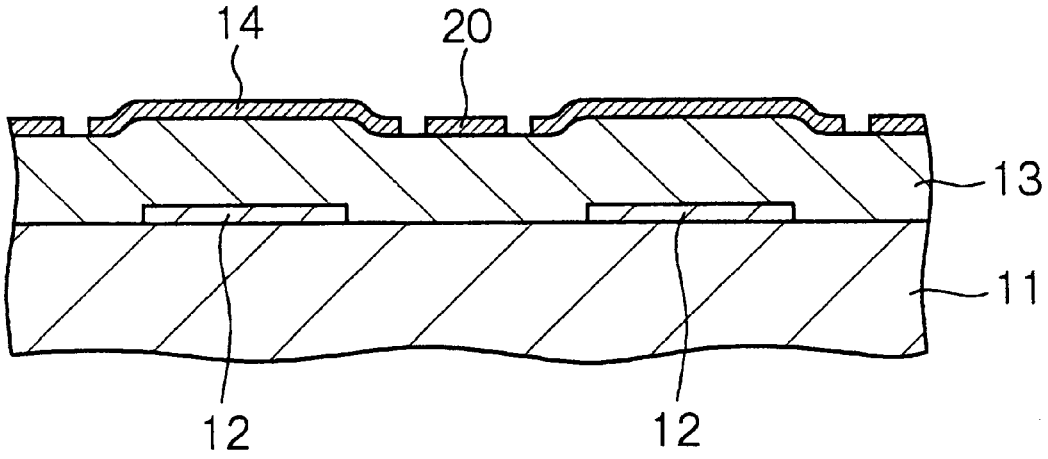

Then, as shown in FIG. 7B, a first insulating layer 13 is formed on the entire surface. For example, an $Sio_2$ layer having a thickness of approximately 0.2 to 1 $\mu$m is formed. Further, an electrically conductive film of tungsten having a thickness of approximately 0.05 to 0.3 $\mu$m is formed on the first insulating layer 13, and the electrically conductive film is patterned to form a wiring 20 extending in the X direction and a rectangular electron emission layer 14.

[Step-120]

Figure 8A:
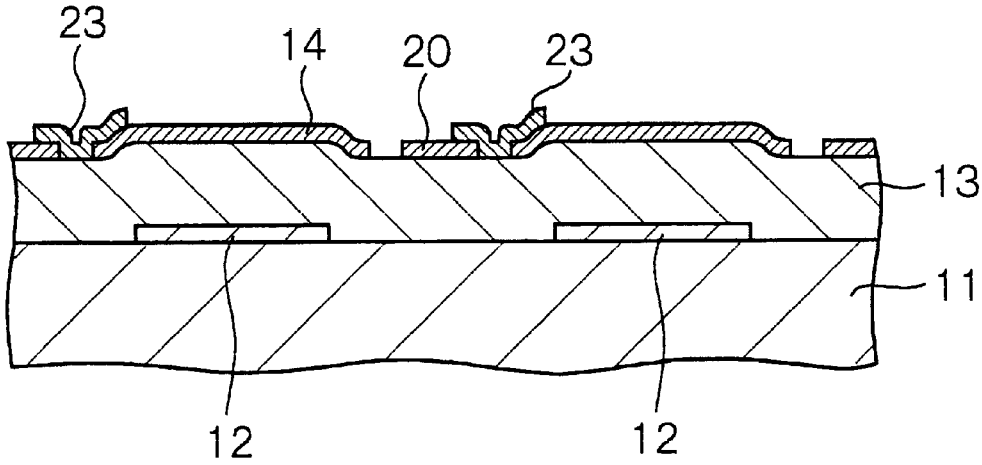
FIGS. 8A and 8B, following

Then, as shown in FIG. 8A, a resistance layer 23 is formed for electrically connecting the electron emission layer 14 and the wiring 20. The resistance layer 23 is formed by forming an approximately 0.05 to 0.2 $\mu$m thick amorphous silicon film on the entire surface, for example, by a plasma CVD method, and patterning the amorphous silicon film according to general procedures by a lithography method and a dry etching method. The dry etching uses a fluorine-containing gas which can generate a fluorine-containing etching species in plasma. The tungsten constituting the electron emission layer 14 and the wiring 20 and the $SiO_2$ constituting the first insulating layer 13 are typical examples of materials which can be etched with a fluorine-containing etching species at a high rate, while the etching rate thereof with a fluorine-containing etching species is far lower than the etching rate of an amorphous silicon. For this reason, the resistance layer 23 can be directly patterned on the electron emission layer 14, the wiring 20 and the first insulating layer 13 without interposing any insulating interlayer.

When the field emission device of Example 1 is produced, [Step-110] is followed by procedures for forming an insulating interlayer 21 having a thickness of approximately 0.05 to 0.1 $\mu$m on the entire surface, forming the hole portions 22 in the insulating interlayer 21 above the wiring 20 and the electron emission layer 14 by a lithography method and a drying etching method and simultaneously patterning the insulating interlayer 21 to a desired pattern, and then, [Step-120] can be carried out.

[Step-130]

Figure 8B:
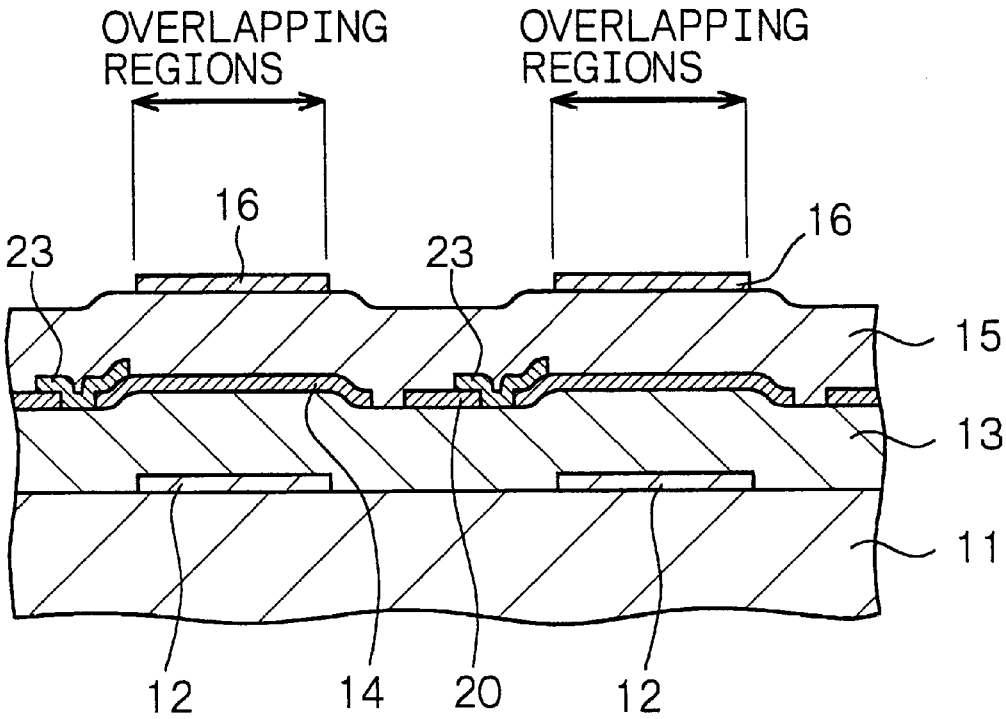

Then, as shown in FIG. 8B, an approximately 0.2 to 1 $\mu$m thick second insulating layer 15 of, for example, $SiO_2$ is formed on the entire surface. Further, a tungsten film having a thickness of 0.05 to 0.3 $\mu$m is formed on the second insulating layer 15, and the second insulating layer 15 is patterned as a pre-determined pattern to form a second gate electrode 16 and a second gate electrode extending portion 16A (not shown in FIG. 8B). The second gate electrode 16 including the second gate electrode extending portion 16A is positionally aligned with the first gate electrode 12 in a longitudinal direction in FIG. 8B showing a cross section including the overlapping region. The material for the second gate electrode 16 and the thickness thereof may be the same as, or different from, those of the first gate electrode 12.

[Step-140]

Figure 9A:
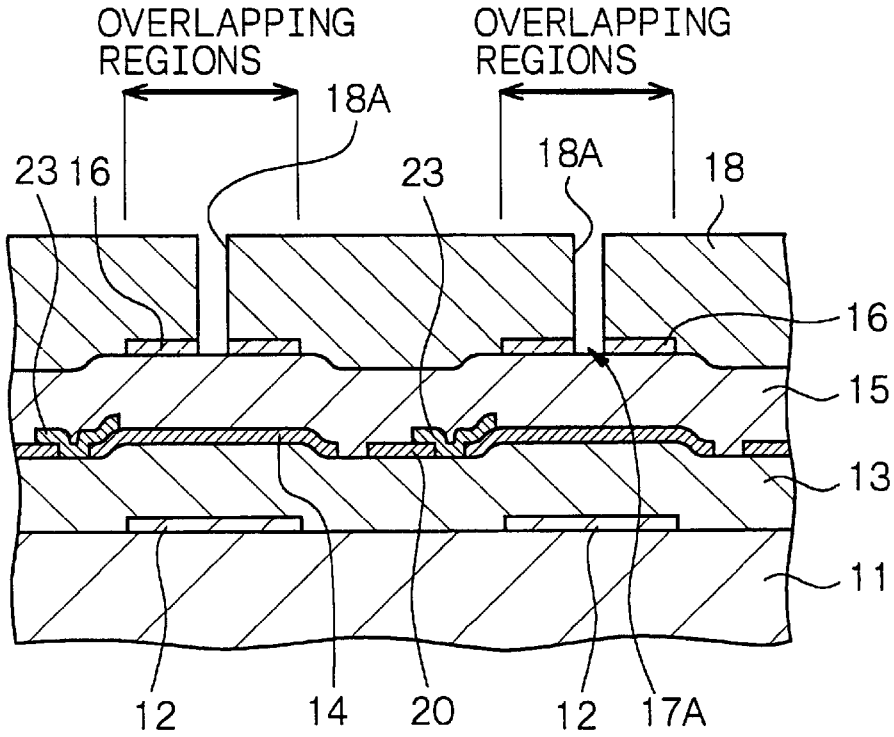
FIGS. 9A and 9B, following

Then, the entire surface is covered with a layer of a resist material, followed by general procedures according to a lithography method and a development treatment, to form a resist pattern 18. The resist pattern 18 has a resist opening portion 18A in which a portion nearly above a central portion of the rectangular electron emission layer 14 is exposed. The resist opening portion 18A has a rectangular form when viewed as a plan view, and FIG. 9A shows a cross section thereof in a minor side direction. The minor side of the rectangular form has a length of approximately 1 $\mu$m to 100 $\mu$m. Then, the second gate electrode 16 exposed in a bottom of the resist opening portion 18 is anisotropically etched, for example, by an RIE (reactive ion etching) method, to form part 17A of the opening portion (see FIG. 9A). Since the second gate electrode 16 is composed of tungsten in this Example, that part 17A of the opening portion which has a perpendicular wall can be formed by etching with an $SF_6$ gas.

[Step-150]

Figure 9B:
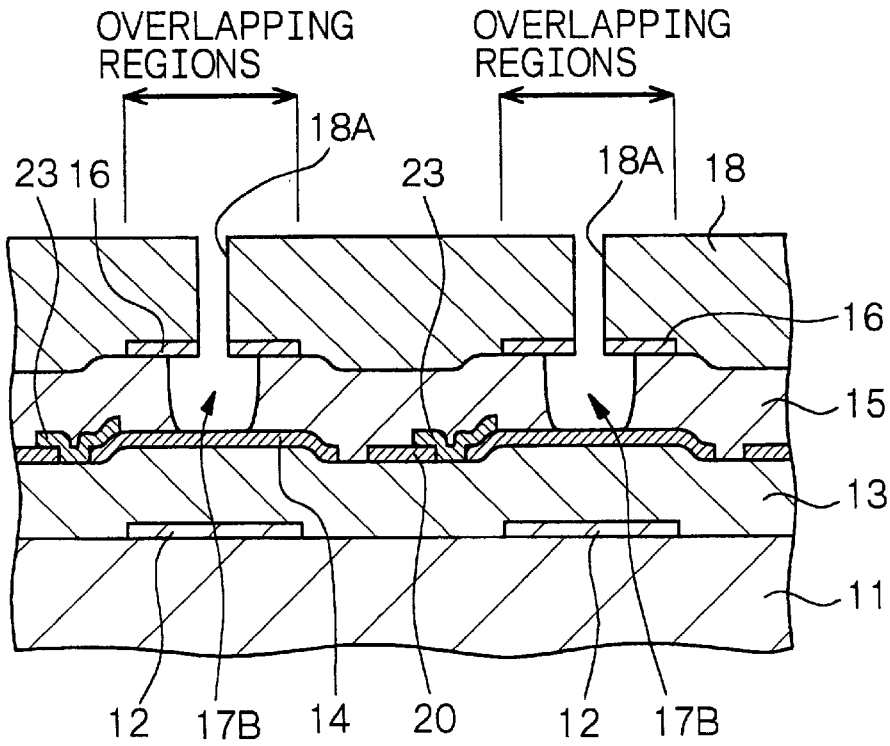

Then, as shown in FIG. 9B, the second insulating layer 15 exposed in a bottom of the part 17A of the opening portion is isotropically etched, to form part 17B of the opening portion. Since the second insulating layer 15 is composed of $SiO_2$ in this Example, wet etching is carried out with a buffered hydrofluoric acid aqueous solution. In this case, the opening-portion-forming surface of the second insulating layer 15 is withdrawn more deeply than the opening end surface (edge) of the second gate electrode 16, and the withdrawal amount thereof can be controlled on the basis of a length of the time period for the wet etching. The wet etching of the second insulating layer 15 is carried out until the lower end portion of the opening portion formed in the second insulating layer 15 is withdrawn more deeply than the opening end surface of the second gate electrode 16.

[Step-160]

Figure 10A:
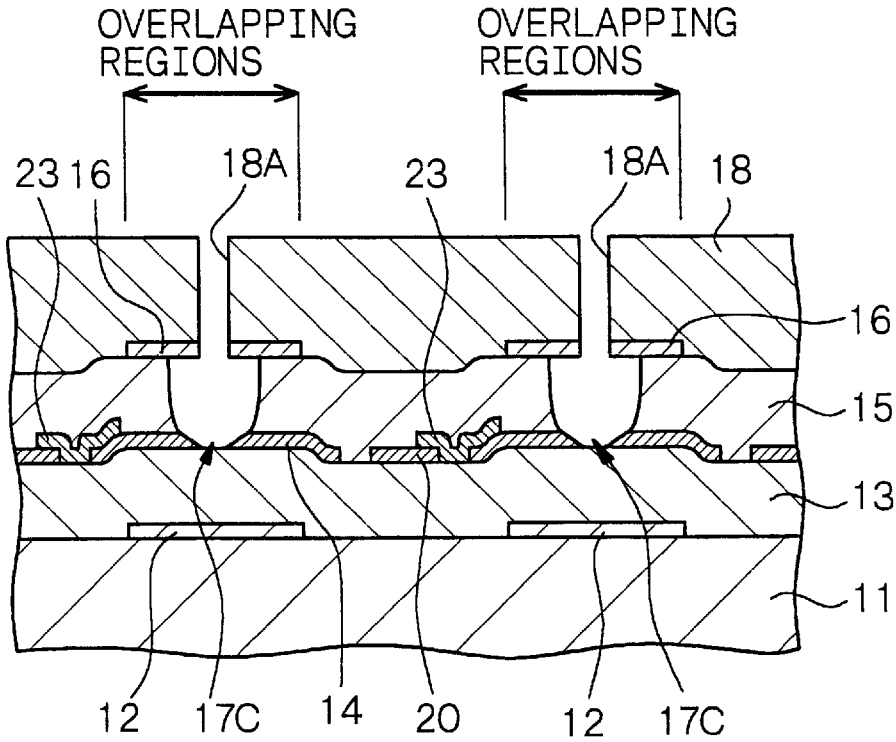
FIGS. 10A and 10B, following

Then, as shown in FIG. 10A, the electron emission layer 14 exposed in the bottom of the part 17B of the opening portion is dry-etched under a condition where ions are a main etching species. In the dry etching using ions as a main etching species, ions as charged particles can be accelerated by applying a bias voltage to a substance to be etched and utilizing synergistic effects of plasma and an electric field, and therefore, generally, anisotropic etching proceeds and the processed surface of the etched substance comes to have a perpendicular wall. In this [Step-160], however, a main etching species in the plasma has, to some extent, incidence components having angles other than the perpendicular, and an oblique incidence components are also generated due to scattering in the opening end portion (edge) of the second gate electrode 16. For these reasons, with some probability, a main etching species arrives at that region of the exposed surface of the electron emission layer 14 which is shielded from ions by the masking with the second gate electrode 16. In this case, a main etching species having a small incidence angle with regard to a normal of the supporting substrate shows a high probability of incidence, and a main etching species having a large incidence angle shows a low probability of incidence.

Therefore, the position of the upper end of the part 17C of the opening portion formed in the electron emission layer 14 is nearly matched with the lower end portion of the second insulating layer 15, while there is brought a state where the lower end portion of the part 17C of the opening portion is projected more than the upper end portion thereof. That is, the thickness of edge portion 14A of the electron emission layer 14 decreases toward the top end portion of the edge portion, and the edge portion is sharpened. If $SF_6$ is used as an etching gas therefor, the electron emission layer 14 can be processed so as to have the above form, and the part 17C of the opening portion can be formed.

[Step-170]

Figure 10B:
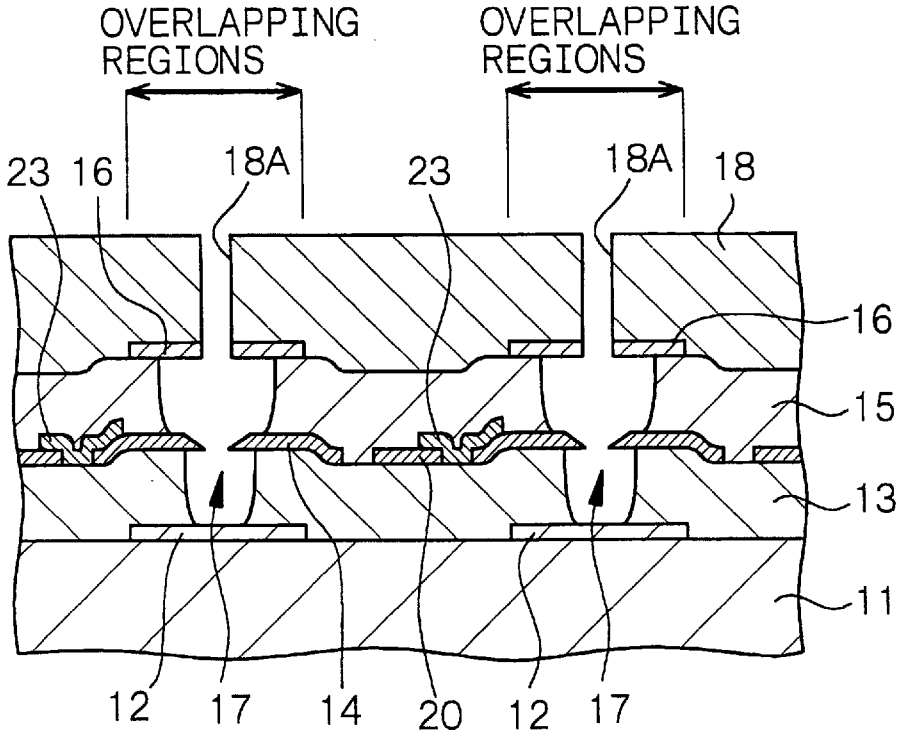

Thereafter, the first insulating layer 13 exposed in the bottom of the part 17C of the opening portion is isotropically etched to complete the opening portion 17 (see FIG. 10B). In the above etching, wet etching using a buffered hydrofluoric acid aqueous solution is carried out like the etching of the second insulating layer 15. The opening-portion-forming surface of the first insulating layer 13 is withdrawn more deeply than the lower end portion of the part 17C of the opening portion formed in the electron emission layer 14. The amount of the above withdrawal can be controlled on the basis of a length of the time period for the wet etching. In this case, the already formed opening-portion-forming surface of the second insulating layer 15 is further withdrawn. After the completion of the opening portion 17, the resist pattern 18 is removed, whereby the configuration shown in FIGS. 6A and 6B can be obtained.

A cathode panel 10 having the field emission devices formed as described above is bonded to an anode panel 30 through a frame, a space between these two panels is evacuated to a high degree of vacuum, and an external power source is connected, to complete the display having edge-type field emission devices. The anode panel 30 has the fluorescence layers 33 and the anode electrode 34 which have desired patterns. The external power source includes a power source (control circuit 53A) for the first gate electrode, a power source (control circuit 53B) for the second gate electrode, a power source (scanning circuit 52) for the electron emission layer, and a power source (accelerating power source 51) for the anode electrode. A positive voltage is applied to the first gate electrode 12 and the second gate electrode 16, and a positive voltage higher than the above is applied to the anode electrode 34 of the anode panel 30. When the electron emission device is operated, a relative negative voltage is applied to the electron emission layer 14, or the electron emission layer 14 is grounded. When the electron emission device is not operated, a voltage nearly equal to the voltage applied to the second gate electrode 16 is applied to the electron emission layer 14.

In the configuration of the above electron emission device, an intense electric field is applied to the edge portion 14A of the electron emission layer 14 which edge portion is projected into the opening portion 17, and electrons are emitted from the edge portion due to a quantum tunnel effect. The emitted electrons partly and directly head for fluorescence layer 33 formed on the anode panel 30, through the opening portion 17, or are bounced back from the surface of the first gate electrode 12 and then head for the fluorescence layer 33. Further, secondary electrons are sometimes generated from the surface of the first gate electrode 12 due to collision of electrons emitted from the electron emission layer 14, and these electrons also head for the fluorescence layer 33. All of these electrons serve to finally excite the fluorescence layer 33 and allow it to emit light.

EXAMPLE 3

Example 3 is a variant of Example 1 or Example 2. In Example 3, the resistance layer 23 is composed of tantalum nitride (TaN) in place of the amorphous silicon. When a film of tantalum nitride is formed by a sputtering method, tantalum nitride can be controlled to have a desired electric resistance value (for example, 6 MΩ) depending upon a sputtering apparatus and a sputtering condition. Further, tantalum nitride has a temperature coefficient of the electric resistance value α of approximately −60 ppm/° C. Therefore, even at a maximum temperature (for example, 550° C., a temperature at which the frit glass is sintered for bonding the cathode panel 10, the anode panel 30 and the frame with the frit glass) to which the resistance layer is exposed when the field emission devices are produced, the electric resistance value of the resistance layer is not much affected by a thermal change, and the change of the electric resistance value by temperatures is small, so that there can be obtained cold cathode field emission devices or a cold cathode field emission display having remarkably excellent electron emission characteristics. A heating step at a maximum temperature of 300° C. to 600° C. is sometimes carried out in some process for the production of the field emission devices. In this case, in the temperature range of from room temperature to the above maximum temperature, the temperature coefficient of the electric resistance value a of the resistance layer is preferably ±100 ppm/° C. or smaller.

The present invention has been explained with reference to the preferred Examples, while the present invention shall not be limited thereto. Particulars of structure of the field emission device, the production method thereof, the processing conditions thereof and details of employed materials may be altered, selected or combined as required.

Examples have explained embodiments in which the stripe-shaped first gate electrode 12 and the stripe-shaped second gate electrode 16 extend in parallel in the same direction (indicated as the Y-direction) and the wiring 20 extends in the second direction (indicated as the X-direction), while the directions in which the stripe-shaped first gate electrode 12, the stripe-shaped second gate electrode 16 and the wiring 20 extend shall not be limited thereto.

Figure 11:
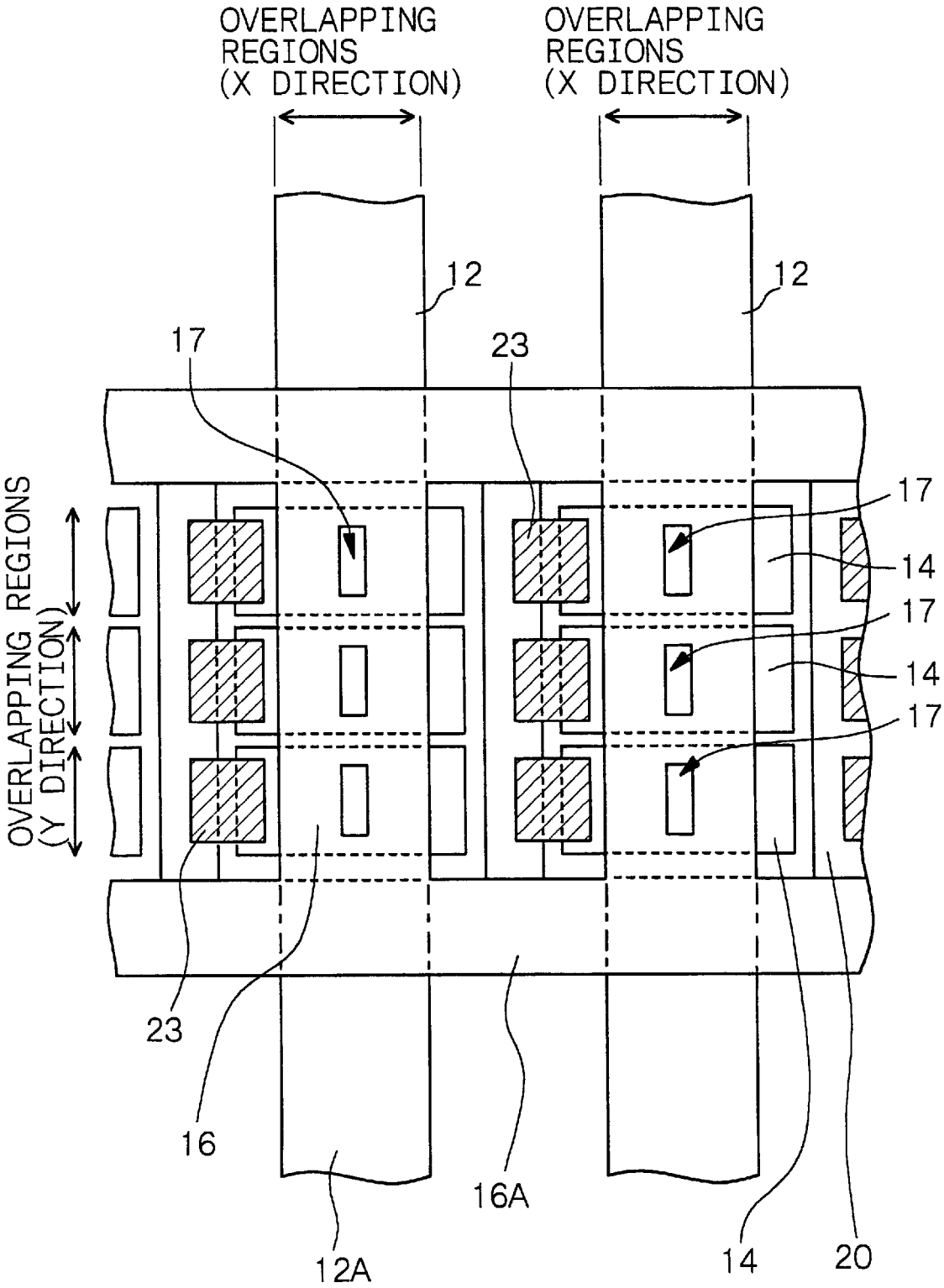
FIG. 11 is a schematic configuration of elements in the vicinity of the opening portions of a variant of the cold cathode field emission device of the present invention.
Figure 12:
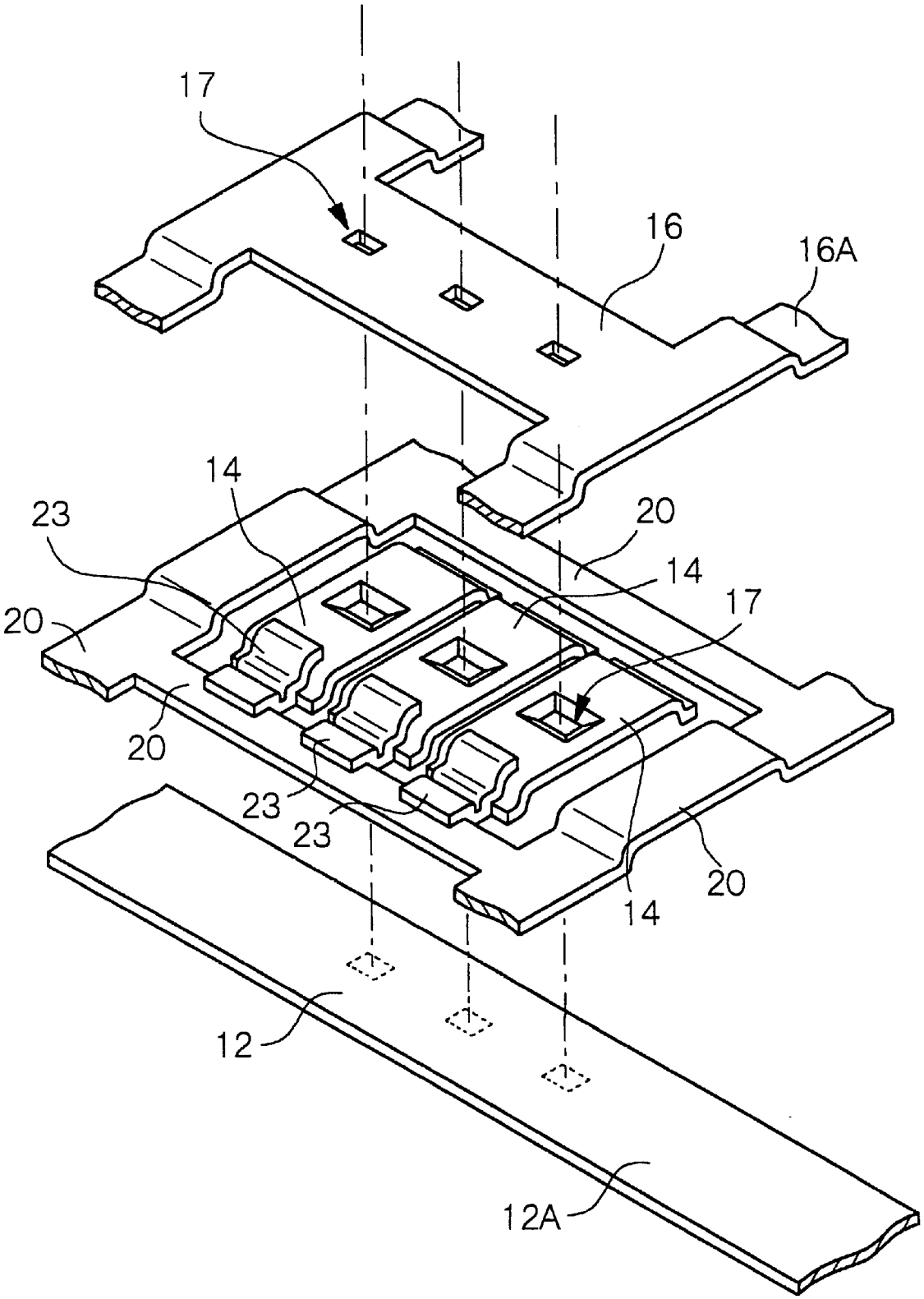
FIG. 12 is an exploded perspective view of the variant of the cold cathode field emission device of the present invention shown in FIG. 11 in the vicinity of the opening portions.
Figure 13:
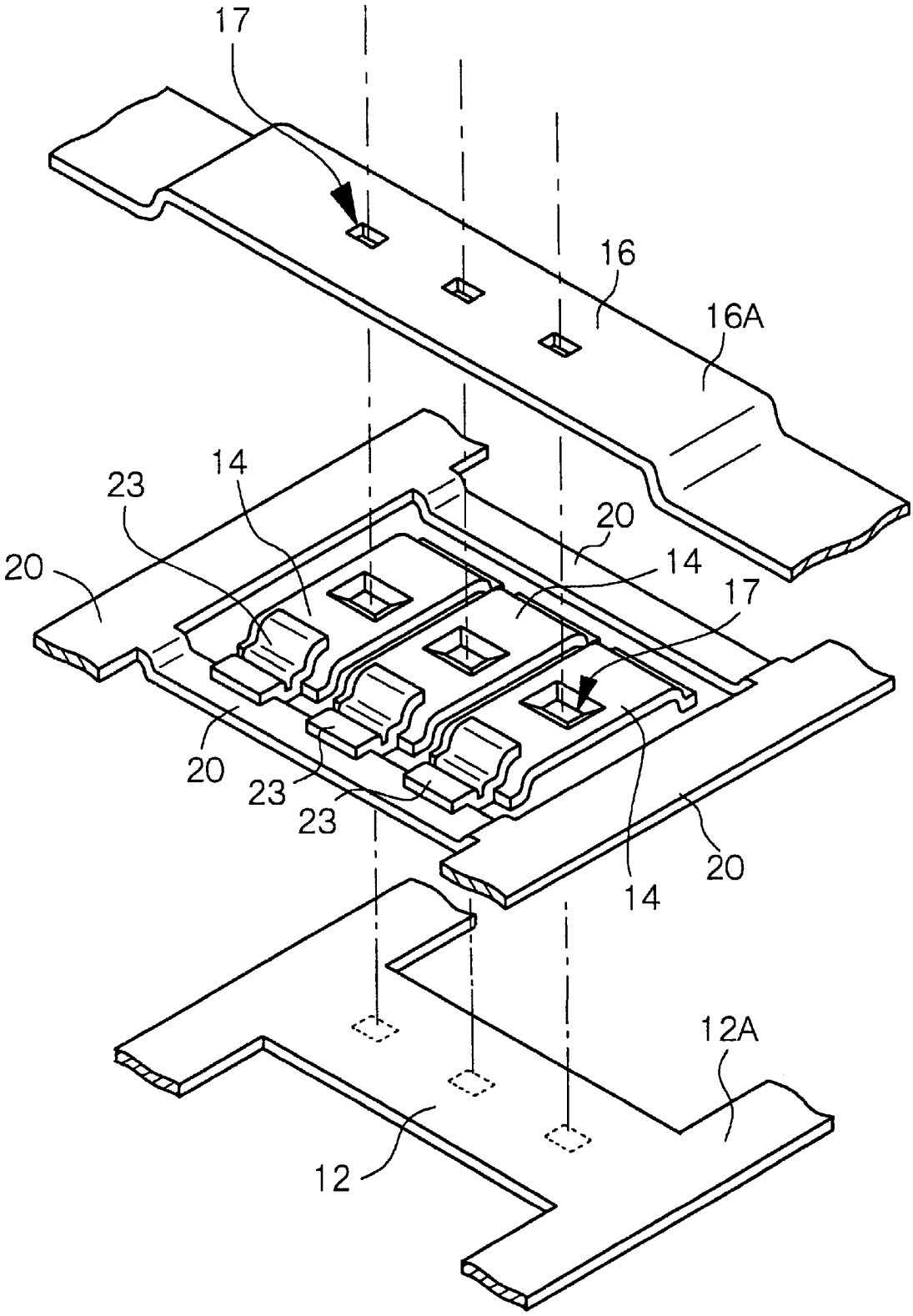
FIG. 13 is an exploded perspective view of another variant of the cold cathode field emission device of the present invention in the vicinity of the opening portions.

As FIG. 11 schematically shows a configuration of elements of a field emission device in the vicinity of an opening portion and as FIG. 12 shows an exploded perspective view of the field emission device in the vicinity of the opening portion, there may be employed an embodiment in which both the wiring 20 and the stripe-shaped second gate electrode 16 extend in the first direction (the X-direction) and the stripe-shaped first gate electrode 12 extends in the second direction (the Y-direction) different from the first direction. Otherwise, as FIG. 13 shows an exploded perspective view of an field emission device in the vicinity of an opening portion, there may be employed an embodiment in which both the wiring 20 and the stripe-shaped first gate electrode 12 extend in the first direction (the X-direction) and the stripe-shaped second gate electrode 16 extends in the second direction (the Y-direction) different from the first direction. In FIGS. 11 to 13, showing of a supporting substrate and all of insulating layers is omitted for the convenience. The first direction and the second direction may form any angle so long as the overlapping region can be efficiently formed, while they have been set at right angles in view of the integration degree of the field emission devices. The configurations of the field emission devices explained in Examples 1 to 3 can be applied to the configurations shown in FIGS. 11 to 13.

Figure 14:
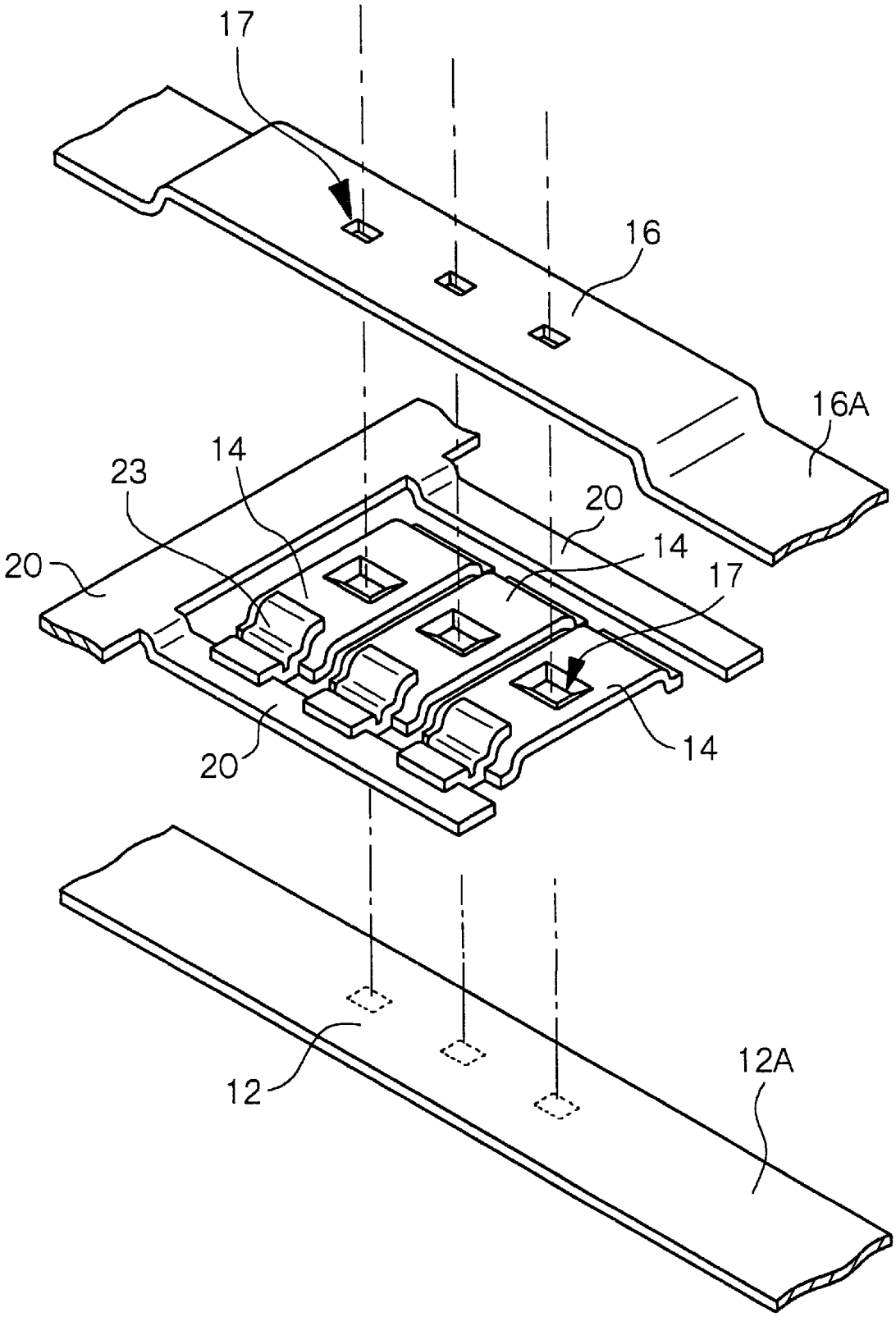
FIG. 14 is an exploded perspective view of a variant of the cold cathode field emission device in Example 1 in the vicinity of the opening portions.

Further, the wiring 20 is not necessarily required to surround the electron emission layer 14, and the field emission device explained in Example 1 can be modified as shown in FIG. 14, which is an exploded perspective view of a field emission device in the vicinity of an opening portion. In the field emission device shown in FIG. 14, a field emission device which is not surrounded by the wiring 20 is present. This embodiment can be applied to the other field emission devices of the present invention.

Figure 15:
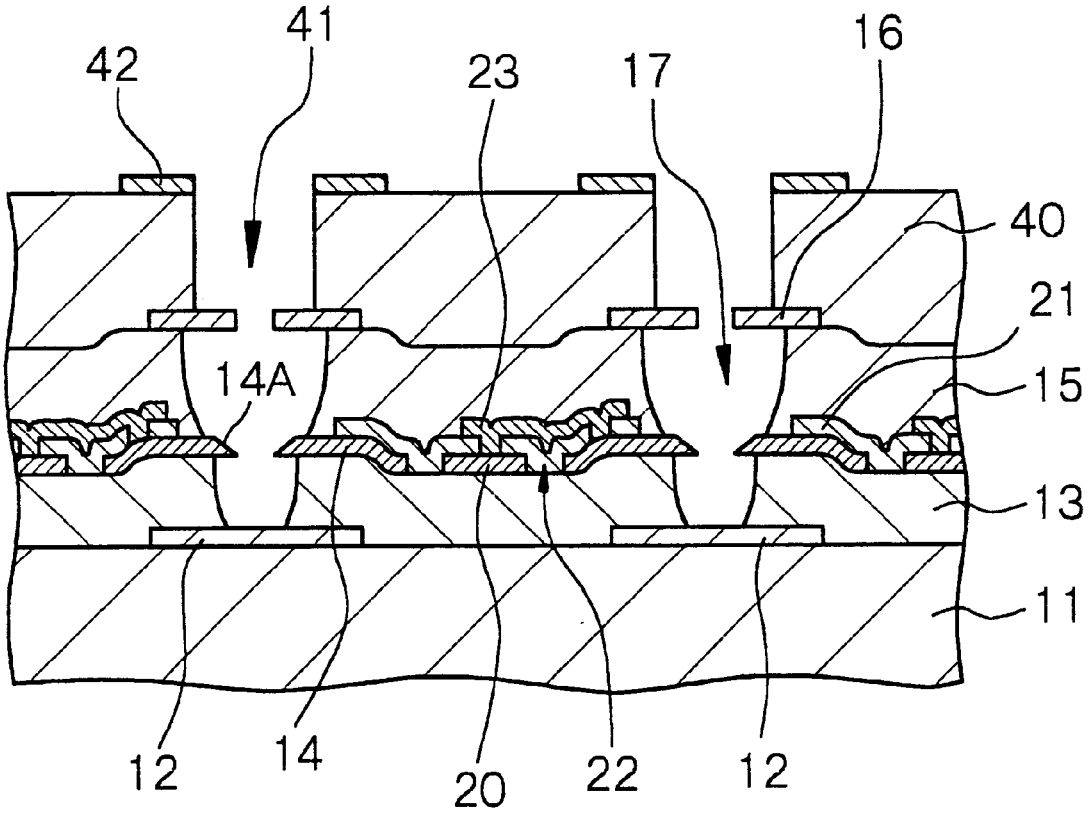
FIG. 15 is a schematic partial end view of the variant of the cold cathode field emission device in Example 1, which is taken along a line similar to line A—A in FIG. 4.

A field emission device shown in FIG. 15 is a variant of the field emission device explained in Example 1. This variant further has a third insulating layer 40 formed on the second insulating layer 15 and the second gate electrode 16, and a focus electrode 42 formed on the third insulating layer 40. The third insulating layer 40 has a second opening portion 41 communicating with the opening portion 17. FIG. 15 shows a schematic end view of the field emission device taken along lines similar to the line A—A in FIG. 4. Preferably, the focus electrode 42 and the electron emission layer 14 are electrically connected to each other. This embodiment can be also applied to the other field emission devices of the present invention.

Figure 16A:
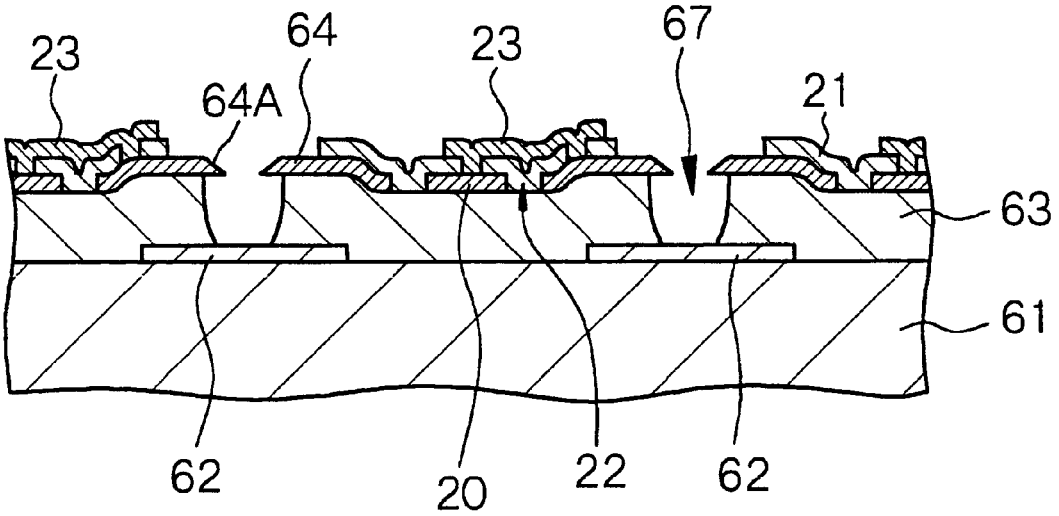
FIGS. 16A and 16B are schematic partial end views of a variant of the cold cathode field emission device according to the first aspect of the present invention.
Figure 16B:
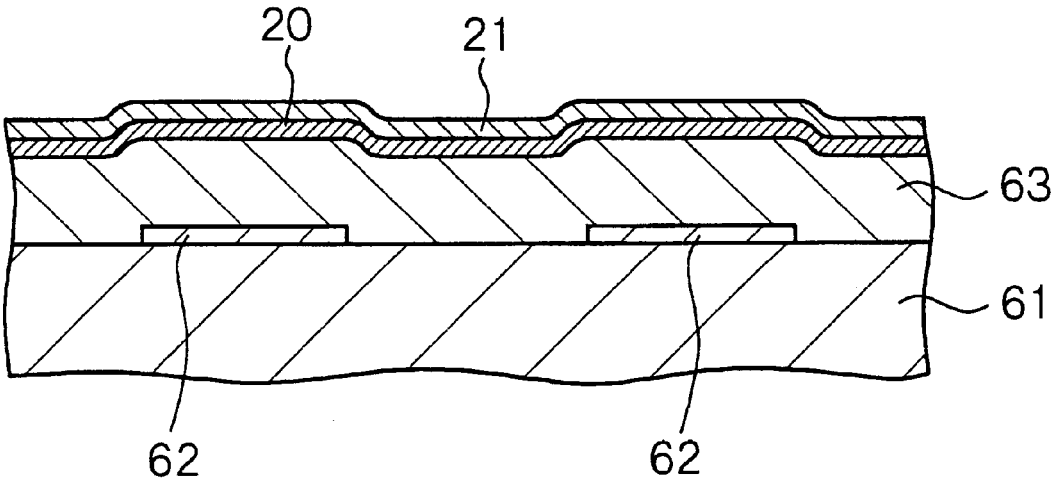

In the field emission device according to the first aspect of the present invention, as FIGS. 16A and 16B shows a schematic partial end view taken along lines similar to the lines A—A and B—B in FIG. 4, the configuration, in which the electron emission layer, the insulating layer and the gate electrode are laminated one on another with the insulating layer positioned between the gate electrode and the electron emission layer, can include a configuration in which a gate electrode 62, an insulating layer 63 and an electron emission layer 64 are laminated one on another with the insulating layer 63 positioned between the gate electrode 62 and the electron emission layer 64, an opening portion 67 which penetrates through the electron emission layer 64 and the insulating layer 63 is formed, electrons are emitted from an edge portion 64A of the electron emission layer 64 which edge portion 64A is projected on a wall surface of the opening portion 67, and the electron emission layer 64 is connected to a power source (for example, a scanning circuit) through the resistance layer 23. Specifically, the above field emission device has a configuration in which the gate electrode 62 is formed on a supporting substrate 61, the insulating layer 63 is formed on the supporting substrate 61 and the gate electrode 62, the electron emission layer 64 and a wiring 20 are formed on the insulating layer 63, and the opening portion 67 penetrates the electron emission layer 64 and the insulating layer 63 and has a surface of the gate electrode 62 exposed in the bottom thereof. Electrons are emitted from the edge portion 64A of the electron emission layer 64, and the wiring 20 and the electron emission layer 64 are electrically connected through the resistance layer 23. When a cathode panel having the above field emission devices is combined with the anode panel explained in Example 1, a cold cathode field emission display can be obtained.

Figure 17A:
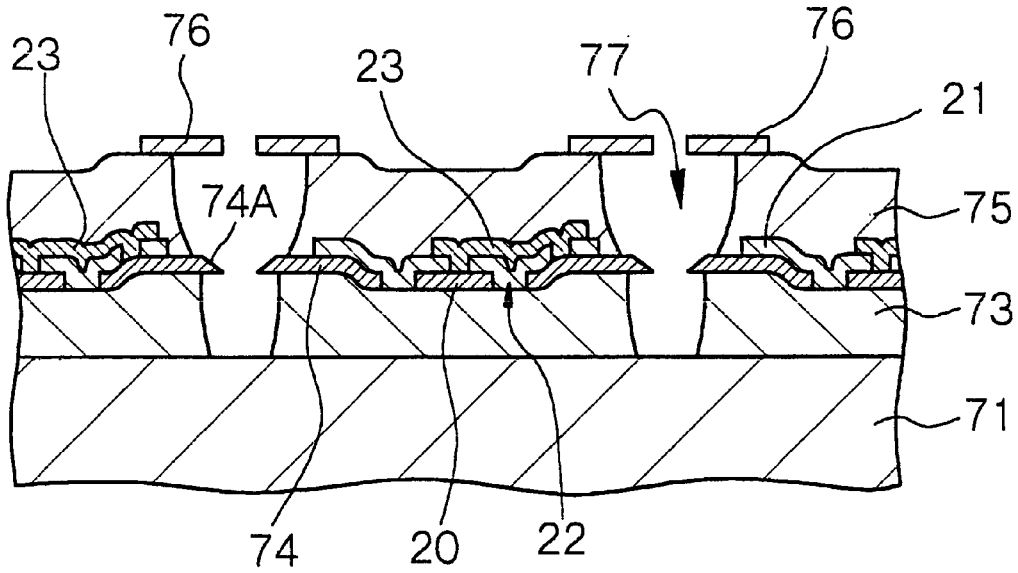
FIGS. 17A and 17B are schematic partial end views of a variant of the cold cathode field emission device according to the first aspect of the present invention.
Figure 17B:
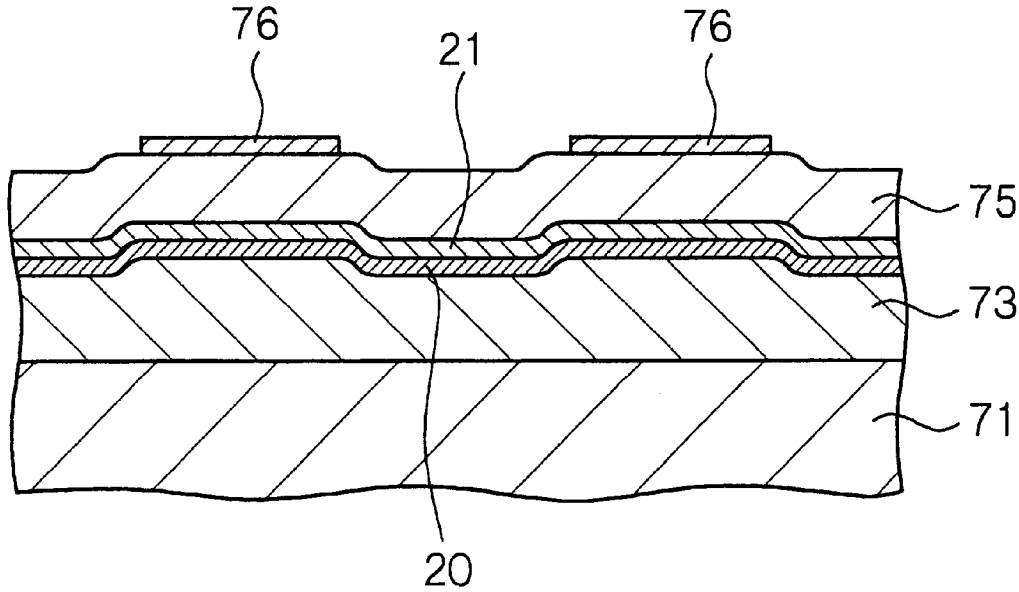
Figure 18:
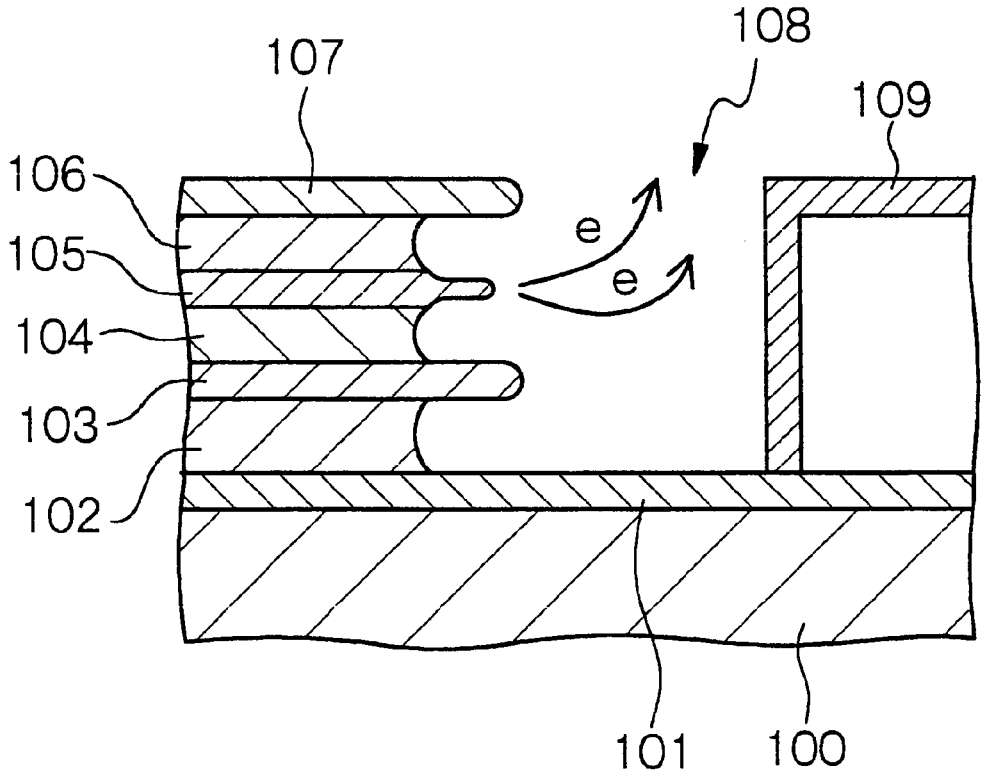
Fig. 18 PRIOR ART
FIG. 18 is a schematic partial end view of one configuration example of a conventional edge-type field emission device.
Figure 19A:
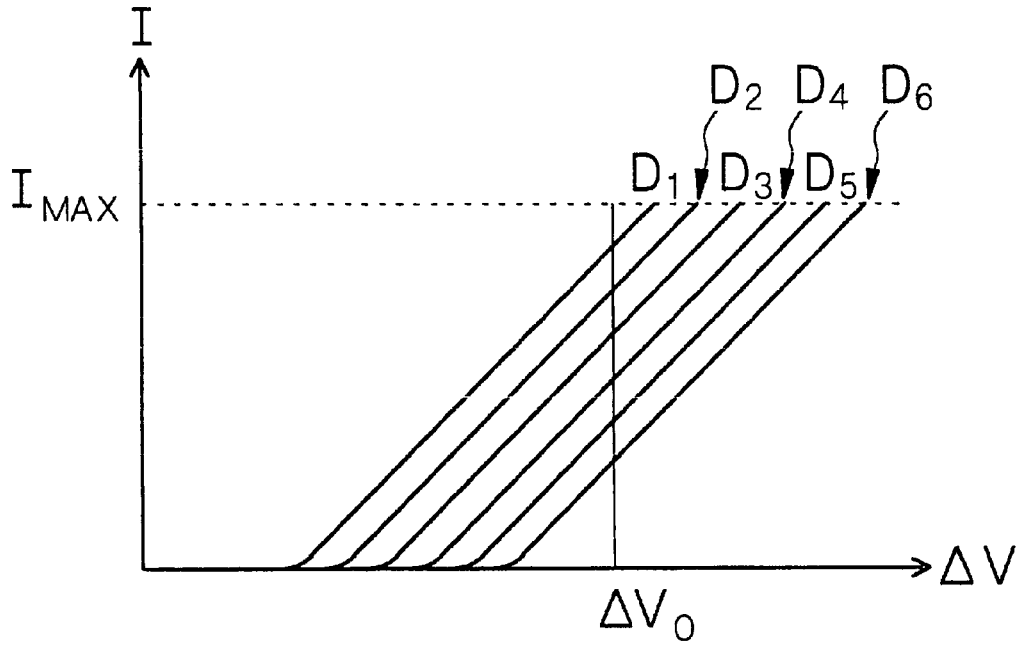
FIGS. 19A and 19B are schematic showings of V-I curves of a cold cathode field emission device of the present invention and a conventional cold cathode field emission device.
Figure 19B:
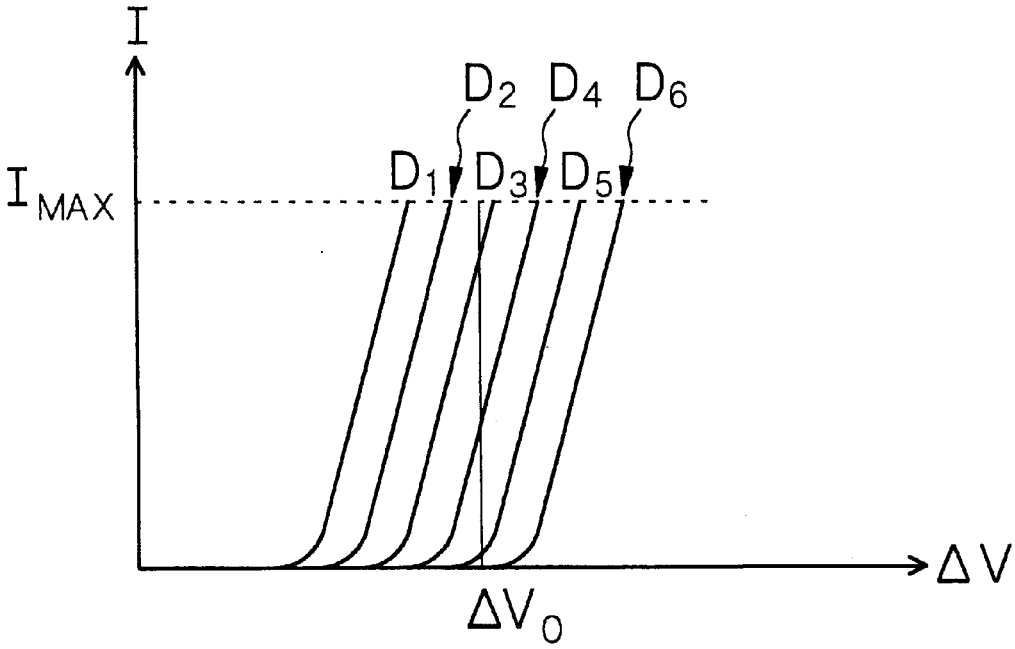

Otherwise, in the field emission device according to the first aspect of the present invention, as FIGS. 17A and 17B show schematic partial end views taken along lines similar to the lines A—A and B—B in FIG. 4, the configuration, in which the electron emission layer, the insulating layer and the gate electrode are laminated one on another with the insulating layer positioned between the gate electrode and the electron emission layer, can include a configuration in which an electron emission layer 74, an insulating layer 75 and a gate electrode 76 are laminated one on another with the insulating layer 75 positioned between the gate electrode 76 and the electron emission layer 74, an opening portion 77 which penetrates at least the insulating layer 75 and the electron emission layer 74 is formed, electrons are emitted from an edge portion 74A of the electron emission layer 74 projected on a wall surface of the opening portion 77, and the electron emission layer 74 is connected to a power source (for example, a scanning circuit) through the resistance layer 23. Specifically, the field emission device has a configuration in which a lower insulating layer 73 is formed on a supporting substrate 71, the electron emission layer 74 and a wiring 20 are formed on the lower insulating layer, the insulating layer 75 is formed on the lower insulating layer 73, the electron emission layer 74 and the wiring 20, the gate electrode 76 is formed on the insulating layer 75 and an opening portion 77 which penetrates through the insulating layer 75 and the electron emission layer 74 is formed. Electrons are emitted from the edge portion 74A of the electron emission layer 74 which edge portion 74A is projected on a wall surface of the opening portion 77, and the wiring 20 and the electron emission layer 74 are electrically connected through the resistance layer 23. As shown in FIG. 17A, the opening portion 77 may be in a state where it penetrates through the lower insulating layer 73 and has the supporting substrate 71 exposed in the bottom thereof, or may be in a state where it is formed only part of the lower insulating layer 73 and the bottom portion of the opening portion 77 is discontinued in the lower insulating layer 73. When a cathode panel having the above field emission devices is combined with the anode panel explained in Example 1, a cold cathode field emission display can be obtained.

As explained above, in the cold cathode field emission device or the cold cathode field emission display of the present invention, the resistance layer is provided which decreases the variation or deviation of electron emission characteristics among the field emission devices, and the fluctuation of a current flowing in the electron emission layer can be suppressed. Further, the change of electron emission characteristics of the field emission devices with the elapse of time can be suppressed, and stable electron emission characteristics can be obtained. Further, when the resistance layer is composed of a material whose electric resistance value is not much affected by a thermal change and is not much changed by temperatures, for example, a material having a temperature coefficient of the electric resistance value $\alpha$ of ±100 ppm/° C. or smaller, there can be obtained a cold cathode field emission device or a cold cathode field emission display having a far more excellent electron emission characteristic. In the cold cathode field emission display of the present invention, therefore, excellent images can be constantly displayed. Further, when the resistance layer is positioned outside the overlapping region in a plane configuration, the field emission device can be driven with a relatively low stray capacitance, and further, the disadvantage of a delay in driving signals caused by an increase in the stray capacitance can be reliably prevented, nor does the load on the electric circuit of the display increase. Further, there are not any problems that the in-plane uniformity and the image quality of the display are downgraded, either.

What is claimed is:

1. A cold cathode field emission device comprising an electron emission layer, an insulating layer and a gate electrode which are laminated one on another with the insulating layer positioned between the gate electrode and the electron emission layer, and further comprising an opening portion which penetrates through at least the insulating layer and the electron emission layer, the electron emission layer having a portion being projected on a wall surface of the opening portion, and the electron emission layer being connected to a power source through a resistance layer, wherein the electric resistance value of the resistance layer is $1\times10^5$ to $5\times10^7$ Ω.

2. The cold cathode field emission device according to claim 1, in which the gate electrode comprises a first gate electrode and a second gate electrode, and the electron emission layer is formed so as to be sandwiched between the first gate electrode and the second gate electrode through a first insulating layer and a second insulating layer.

3. The cold cathode filed emission device according to claim 2, further including wiring formed on the insulating layer, wherein the wiring and the electron emission layer being electrically connected to each other with a resistance layer.

4. The cold cathode field emission device according to claim 1, in which the resistance layer is formed in a region other than an overlapping region where the gate electrode and the electron emission layer overlap each other.

5. A cold cathode field emission device comprising;

(A) a first gate electrode formed on a supporting substrate, (B) a first insulating layer formed on the supporting substrate and the first gate electrode, (C) an electron emission layer formed on the first insulating layer, (D) a wiring formed on the first insulating layer, (E) a second insulating layer formed on the first insulating layer, the electron emission layer and the wiring, (F) a second gate electrode formed on the second insulating layer, and (G) an opening portion which penetrates through the second gate electrode, the second insulating layer, the electron emission layer and the first insulating layer and has a bottom portion on which a surface of the first gate electrode is exposed, the electron emission layer having an edge portion for emitting electrons, the edge portion being projected on a wall surface of the opening portion, and the wiring and the electron emission layer being electrically connected to each other with a resistance layer.

6. The cold cathode field emission device according to claim 5, in which the electric resistance value of the resistance layer is $1\times10^5$ to $5\times10^7$ Ω.

7. The cold cathode field emission device according to claim 5, in which the temperature coefficient of the electric resistance value of the resistance layer is ±100 ppm/° C. or smaller.

8. The cold cathode field emission device according to claim 7, in which the resistance layer is composed of tantalum nitride.

9. The cold cathode field emission device according to claim 5, in which the first gate electrode is connected with the first gate electrode of the adjacent field emission device through a first gate electrode extending portion, the first gate electrode including the first gate electrode extending portion has the form of a stripe when viewed as a plan view, the second gate electrode is connected with the second gate electrode of the adjacent field emission device through a second gate electrode extending portion, the second gate electrode including the second gate electrode extending portion has the form of a stripe when viewed as a plan view, the wiring has an outer form similar to a stripe when viewed as a plan view, two members of the first gate electrode with the first gate electrode extending portion, the wiring, the second gate electrode with the second gate electrode extending portion extend in a first direction, and the remaining member extends in a second direction different from the first direction, and the resistance layer is formed in a region other than an overlapping region where the first gate electrode, the electron emission layer and the second gate electrode are overlapped when viewed from the direction of the normal of the supporting substrate.

10. The cold cathode field emission device according to claim 9, in which the wiring surrounds the electron emission layer.

11. The cold cathode field emission device according to claim 10, in which the resistance layer is formed on the electron emission layer, the wiring and the first insulating layer.

12. The cold cathode field emission device according to claim 11, in which the resistance layer is composed of a material showing a higher etching rate to a specific etching species than the electron emission layer, the wiring and the first insulating layer.

13. A cold cathode field emission display having a plurality of pixels, each pixel comprising a cold cathode field emission device, and an anode electrode and a fluorescent layer formed on a substrate so as to face the cold cathode field emission device, each cold cathode field emission device comprising;

(A) a first gate electrode formed on a supporting substrate, (B) a first insulating layer formed on the supporting substrate and the first gate electrode, (C) an electron emission layer formed on the first insulating layer, (D) a wiring formed on the first insulating layer, (E) a second insulating layer formed on the first insulating layer, the electron emission layer and the wiring, (F) a second gate electrode formed on the second insulating layer, and (G) an opening portion which penetrates through the second gate electrode, the second insulating layer, the electron emission layer and the first insulating layer and has a bottom portion on which a surface of the first gate electrode is exposed, the electron emission layer having an edge portion for emitting electrons, the edge portion being projected on a wall surface of the opening portion, and the wiring and the electron emission layer being electrically connected to each other with a resistance layer.

* * * * *

UNITED STATES PATENT AND TRADEMARK OFFICE

CERTIFICATE OF CORRECTION

PATENT NO. : 6,278,228 B1
DATED : August 21, 2001
INVENTOR(S) : Yuichi Iwase; Masami Okita It is certified that error appears in the above-identified patent and that said Letters Patent is hereby corrected as shown below:

Title page,
Item [57], ABSTRACT, lines 1 and 5, replace "having" with -- comprising --.

Signed and Sealed this

Twenty-sixth Day of March, 2002

*Attest:*

*Attesting Officer*

JAMES E. ROGAN
*Director of the United States Patent and Trademark Office*